US011299839B2

(12) United States Patent
Jones et al.

(10) Patent No.: US 11,299,839 B2
(45) Date of Patent: Apr. 12, 2022

(54) APPARATUS AND METHOD FOR TREATING A SUBSTRATE WITH SOLID PARTICLES

(71) Applicant: Xeros Limited, Rotherham (GB)

(72) Inventors: Gareth Evan Lyn Jones, Bath (GB); Christopher Holden, Bath (GB); David Stevens, Bath (GB)

(73) Assignee: Xeros Limited, Rotherham (GB)

( * ) Notice: Subject to any disclaimer, the term of this patent is extended or adjusted under 35 U.S.C. 154(b) by 0 days.

(21) Appl. No.: 17/258,396

(22) PCT Filed: Jul. 12, 2019

(86) PCT No.: PCT/EP2019/068913

§ 371 (c)(1),
(2) Date: Jan. 6, 2021

(87) PCT Pub. No.: WO2020/012027

PCT Pub. Date: Jan. 16, 2020

(65) Prior Publication Data

US 2021/0292957 A1 Sep. 23, 2021

(30) Foreign Application Priority Data

Jul. 13, 2018 (GB) ..... 1811568

(51) Int. Cl.
*D06F 37/04* (2006.01)
*D06F 35/00* (2006.01)
*D06F 39/02* (2006.01)

(52) U.S. Cl.
CPC ..... *D06F 37/04* (2013.01); *D06F 35/006* (2013.01); *D06F 39/02* (2013.01)

(58) Field of Classification Search
CPC ..... D06F 37/04
See application file for complete search history.

(56) References Cited

U.S. PATENT DOCUMENTS 8,959,961 B2 2/2015 Jenkins et al.
8,974,545 B2 3/2015 Burkinshaw et al.
(Continued)

FOREIGN PATENT DOCUMENTS

CN 102061588 A 5/2011
CN 102061589 A 5/2011
(Continued)

OTHER PUBLICATIONS

U.S. Appl. No. 17/258,406, Xeros Ltd.
(Continued)

*Primary Examiner* — Jason Y Ko
(74) *Attorney, Agent, or Firm* — Clark & Elbing LLP

(57) ABSTRACT

Aspects relate to a drum (10) for rotatably mounting in an apparatus for use in the treatment of substrates with a solid particulate material; a method of treating a substrate comprising agitating the substrate in a drum (10); and a kit for converting an apparatus to comprise the drum (10). The drum has an inner surface (15) and an end wall (2) and access means (70) for introducing said substrates into said drum, wherein said drum (10) comprises: •(a) storage means (4) for storage of said solid particulate material, wherein at least part of said storage means is or comprises at least one cavity located in said end wall (2) of said drum (10); and•(c) a dispensing aperture (12) for dispensing solid particulate material from said storage means (4) into the interior of said drum (10), wherein said dispensing aperture (12) is comprised in said end wall (2) of said drum, characterised in that said drum (10) comprises a valve (6) that is actuatable between a closed position and an open position, wherein when said valve (6) is in said closed position said solid particulate material is prevented from passing through said dispensing aperture (12) and when said valve (6) is in said
(Continued)

open position said solid particulate material is permitted to pass through said dispensing aperture (12).

55 Claims, 8 Drawing Sheets

(56) References Cited

U.S. PATENT DOCUMENTS

| | | | |
|---|---|---|---|
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |
| 10,494,590 | B2 | 12/2019 | Abercrombie et al. |
| 10,590,499 | B2 | 3/2020 | Ashfaq et al. |
| 10,597,814 | B2 | 3/2020 | Wells et al. |
| 10,745,769 | B2 | 8/2020 | Steele |
| 10,773,976 | B2 | 9/2020 | Scott et al. |
| 10,781,404 | B2 | 9/2020 | Bird et al. |
| 10,808,289 | B2 | 10/2020 | Sadeghi |
| 2011/0296628 | A1 | 12/2011 | Jenkins et al. |
| 2012/0048299 | A1 | 3/2012 | Jenkins et al. |
| 2013/0167882 | A1 | 7/2013 | Burkinshaw et al. |
| 2014/0201929 | A1 | 7/2014 | He et al. |
| 2014/0230160 | A1 | 8/2014 | He et al. |
| 2014/0283314 | A1 | 9/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0175945 | A1 | 6/2015 | Waddon et al. |
| 2015/0252511 | A1 | 9/2015 | Roberts et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2017/0051447 | A1 | 2/2017 | He et al. |
| 2017/0159222 | A1 | 6/2017 | Jenkins et al. |
| 2017/0241061 | A1 | 8/2017 | Wells et al. |
| 2017/0247771 | A1 | 8/2017 | Scott |
| 2018/0057777 | A1 | 3/2018 | Waddon et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |
| 2019/0211288 | A1 | 7/2019 | Potts et al. |
| 2019/0233760 | A1 | 8/2019 | Lavery et al. |
| 2020/0002650 | A1 | 1/2020 | Servin et al. |
| 2020/0316501 | A1 | 10/2020 | Jones |
| 2020/0378054 | A1 | 12/2020 | Cobb et al. |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 302020695 | S | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103290653 | A | 9/2013 |
| CN | 103361934 | A | 10/2013 |
| CN | 103361938 | A | 10/2013 |
| CN | 203370359 | U | 1/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| EP | 0077463 | A2 | 4/1983 |
| WO | WO-2014/147390 | A1 | 9/2014 |
| WO | WO-2014/147391 | A1 | 9/2014 |
| WO | WO-2016/055789 | A1 | 4/2016 |
| WO | WO-2017/178831 | A2 | 10/2017 |
| WO | WO-2020/012024 | A1 | 1/2020 |
| WO | WO-2020/012026 | A1 | 1/2020 |
| WO | WO-2020/064830 | A1 | 4/2020 |
| WO | WO-2021/014152 | A1 | 1/2021 |
| WO | WO-2021/032986 | A1 | 2/2021 |

OTHER PUBLICATIONS

U.S. Appl. No. 17/271,497, Xeros Ltd.
U.S. Appl. No. 17/280,519, Xeros Ltd.

(56) References Cited

OTHER PUBLICATIONS

International Search Report and Written Opinion for International Application No. PCT/EP2019/068913, dated Jan. 16, 2020 (16 pages).
UKIPO Search Report for GB Application No. GB1811568.3, dated Dec. 21, 2018 (3 pages).

APPARATUS AND METHOD FOR TREATING A SUBSTRATE WITH SOLID PARTICLES

The present disclosure relates to a drum for use in an apparatus and to an apparatus that employs a multiplicity of solid particles in the treatment of substrates, particularly a substrate which is or comprises a textile. The present disclosure further relates to a method for the treatment of substrates with solid particles using the apparatus. The present disclosure particularly relates to an apparatus, components thereof (in particular the drum) and a method suitable for cleaning of soiled substrates. The present disclosure further relates to a kit and method suitable for retrofitting or converting an apparatus into an apparatus according to the present disclosure.

Conventional methods for treating and cleaning of textiles and fabrics typically involve aqueous cleaning using large volumes of water. These methods generally involve aqueous submersion of fabrics followed by soil removal, aqueous soil suspension, and water rinsing. The use of solid particles to provide improvements in, and advantages over, these conventional methods is known in the art. For example PCT patent publication WO2007/128962 discloses a method for cleaning a soiled substrate using a multiplicity of solid particles. Other PCT patent publications which have related disclosures of cleaning methods include: WO2012/056252; WO2014/006424; WO2015/004444; WO2014/147390; WO2014/147391; WO2014/006425; WO2012/035343, WO2012/167545; WO2011/098815; WO2011/064581; WO2010/094959; and WO2014/147389. These disclosures teach apparatus and methods for treating or cleaning a substrate which offers several advantages over conventional methods including: improved treating/cleaning performance, reduced water consumption, reduced consumption of detergent and other treatment agents, and better low temperature treating/cleaning (and thus more energy efficient treating/cleaning). Other patent applications, for instance WO2014/167358, WO2014/167359, WO2016/051189, WO2016/055789 and WO2016/055788, teach the advantages provided by solid particles in other fields such as leather treatment and tanning.

It would be desirable to provide even better apparatus for treatment methods which involve the use of a multiplicity of solid particles. In particular, it would be desirable to improve the efficiency and reliability, to further reduce water consumption, to facilitate quieter operation, to improve fabric care, and/or to reduce the power consumption and costs (including capital costs and/or running costs) of the apparatus and the operation thereof. It would also be desirable to reduce the complexity of the apparatus and the number of moving components therein. Furthermore, it would also be desirable to retrofit a conventional apparatus so that it is suitable for operation with a multiplicity of solid particles.

The present Applicant's pending PCT application PCT/GB2017/053815 discloses an apparatus in which solid particles are stored in a rotatable drum which further provides a plurality of dispensing flow path(s) for the solid particles to flow from the storage compartment(s) to the interior of the drum, and a plurality of collecting flow paths for the solid particles to flow from the interior of the drum to the storage compartment(s), such that the direction of flow between the storage compartment(s) and the interior of the drum is controlled by the direction of rotation of the drum.

The present inventors sought to provide further improvements to the apparatus. In particular, the present inventors sought to increase the efficiency and/or rate of dispensing of solid particulate material into the interior of the drum.

Furthermore, the present inventors sought to improve the control of the dispensing of solid particulate material into the interior of the drum. In addition, the present inventors sought to provide an arrangement in which dispensing of solid particulate material into the interior of the drum is less dependent on direction of drum rotation in order to give greater flexibility in the design of treatment cycles.

It is an object of the present invention to address one or more of the aforementioned problems.

According to a first aspect of the invention, there is provided a drum for rotatably mounting in an apparatus for use in the treatment of substrates with a solid particulate material, said drum having an inner surface and an end wall and access means for introducing said substrates into said drum, wherein said drum comprises:

(a) storage means for storage of said solid particulate material, wherein at least part of said storage means is or comprises at least one cavity located in said end wall of said drum; and (c) a dispensing aperture for dispensing solid particulate material from said storage means into the interior of said drum, wherein said dispensing aperture is comprised in said end wall of said drum, characterised in that said drum comprises a valve that is actuatable between a closed position and an open position, wherein when said valve is in said closed position said solid particulate material is prevented from passing through said dispensing aperture and when said valve is in said open position said solid particulate material is permitted to pass through said dispensing aperture.

According to a second aspect of the invention, there is provided an apparatus for use in the treatment of substrates with a solid particulate material, said apparatus comprising a housing having mounted therein a rotatably mounted drum, wherein said drum is as disclosed herein.

The drum and the apparatus of the present invention can dispense solid particulate material directly into the interior of the drum in a controlled manner. Furthermore, the drum and the apparatus of the present invention can increase the rate at which solid particulate material can be dispensed into the interior of the drum. In addition, the drum and the apparatus of the present invention allows for dispensing of solid particulate material into the interior of the drum is regardless of direction of drum rotation, thereby allowing greater flexibility in the design of treatment cycles.

The apparatus of the present invention can also dispense with, and preferably does not comprise, a further storage means which is not attached to or integral with the drum (for instance a sump for storage of solid particulate material, such as a sump located beneath the drum). Similarly, the apparatus can dispense with, and preferably does not comprise, a pump for circulating said solid particulate material between the storage means and the interior of the drum (i.e. from the storage means to the interior of the drum, and from the interior of the drum to the storage means). Preferably, the apparatus can dispense with, and preferably does not comprise, a pump for circulating said solid particulate material.

In addition, the amount of water used in the treatment of the substrates is reduced because water is not required to transport the solid particulate material around the apparatus. The apparatus and methods of the present invention therefore only require the water needed as the liquid medium in the treatment of the substrates, which provides a significant reduction in water consumption.

A further advantage of the storage means being located in the rotatable drum is that solid particulate material can be centrifugally dried, i.e. it can undergo one or more spin cycles to dry the particles. Centrifugal drying of the solid particulate material may be separate from or included in the operation of the apparatus to treat substrates. For instance, centrifugal drying may be effected concurrently with extraction step(s) for removing liquid medium, as described herein. Thus, the method described herein for treating a substrate optionally comprises the step of centrifugal drying of the solid particulate material. It will therefore be appreciated that an advantage of the present invention is the dry storage of the solid particulate material.

It will be appreciated that the rate of flow of the solid particulate material between the interior of the drum and the storage means may also be controlled, additionally or alternatively, by varying the rate of rotation of the drum and/or by intermittently rotating the drum.

The apparatus is preferably a front-loading apparatus, with the access means disposed in the front of the apparatus. Preferably the access means is or comprises a door. It will be appreciated that the drum has an opening at the opposite end of the drum to the end wall, suitably wherein the opening is aligned with the access means, and through which opening said substrates are introduced into said drum.

The rotatably mounted drum (also referred to herein as a rotatable drum) is preferably cylindrical, but other configurations are also envisaged, including for instance hexagonal drums.

Thus, the inner surface of the drum is preferably a cylindrical inner surface.

The inner surface of the drum is the surface of the inner wall(s) of the drum. The inner wall(s) of the drum is/are joined to the end wall of the drum at the juncture of the inner and end walls. Thus, the inner surface is the surface of the inner wall of the drum which is disposed around the rotational axis of the drum, i.e. substantially perpendicular to the end wall of the drum.

For a cylindrical drum, the axis of the cylindrical drum is preferably the rotational axis of the drum. More generally, the inner and end walls of the drum define a three-dimensional volume in which the end wall intersects the rotational axis of the drum, and preferably intersects said rotational axis in a substantially perpendicular manner, and wherein the inner wall(s) is/are disposed around the rotational axis, preferably wherein the inner walls are substantially parallel to the rotational axis.

The inner surface of the drum preferably comprises perforations which have dimensions smaller than the longest dimension of the solid particulate material so as to permit passage of fluids into and out of said drum but to prevent egress of said solid particulate material (which is the opposite of many prior art apparatus, in which both fluids and solid particulate material exit the drum via perforations in its inner surface). Preferably the housing of the apparatus is a tub which surrounds said drum, preferably wherein said tub and said drum are substantially concentric, preferably wherein the walls of said tub are unperforated but having disposed therein one or more inlets and/or one or more outlets suitable for passage of a liquid medium and/or one or more treatment formulation(s) into and out of the tub. Thus, the tub is suitably water-tight, permitting ingress and egress of the liquid medium and other liquid components only through pipes or ducting components.

Preferably, the drum is disposed in the apparatus such that the axis of the drum is substantially horizontal. In a preferred embodiment, the drum is disposed in the apparatus such that the axis of the drum is substantially horizontal during at least part of the operation of the apparatus, and preferably during the whole of the operation of the apparatus. The improved collection rate of the apparatus of the present invention provides significant improvement in the collection efficiency for apparatus in which the axis of the drum is substantially horizontal during operation.

In an alternative embodiment, the apparatus and/or drum (and particularly the drum) is tiltable, as is known in the art, such that the axis of the drum to the horizontal plane can be varied before, during or after the treatment of the substrates in the apparatus, and preferably during the treatment or portion thereof, and particularly during rotation of the drum in a collecting direction. Tilting may be effected by any suitable means, including for instance an air bag, hydraulic ram, pneumatic piston and/or electric motor. In this embodiment, the drum and/or apparatus is tiltable preferably such that the axis of the drum defines an angle $\alpha$ to the horizontal plane which is greater than 0 and less than about 10°. In this embodiment, the drum and/or apparatus is preferably configured to be tiltable such that the drum is inclined in a downwards direction from the front of the drum to the end wall of the drum during at least a part of said treatment, and particularly during rotation of the drum in a collecting direction. Thus, the apparatus is suitably configured such that for at least a part of said treatment (particularly during rotation of the drum in a collecting direction) the axis of the drum is tilted such that it defines an angle $\alpha$ to the horizontal plane which is greater than 0 and less than about 10° and such that the drum is inclined in a downwards direction from the front of the drum to the end wall of the drum.

Advantageously, during operation of the apparatus of the present invention, neither the drum nor the tub allows ingress or egress of the solid particulate material, which is retained by the drum throughout the treatment cycle by which substrates are treated in the apparatus. In other words, the solid particulate material remains in the storage means and/or in the interior of the drum and/or in a flow path between the storage means and the interior of the drum throughout the treatment cycle, thereby obviating the need for a pump to circulate the particulate material and thereby obviating the need for a further storage means (such as a sump) which is not attached to or integral with the drum.

The apparatus preferably comprises a seal between the access means and the tub such that, in use, liquid medium is not able to exit the tub. Preferably, said seal is a door seal, as is conventional in the art. The seal between the access means and the tub prevents water leakage from the apparatus. The apparatus preferably further comprises a seal which prevents egress of the solid particulate material from the drum at the periphery thereof, in order to prevent egress of solid particulate material into the tub or egress of solid particulate material from the apparatus at the periphery of the access means, and such a seal is preferably disposed as a seal between the access means and the drum. Typically, said seal is made from foam or rubber or some other resiliently flexible material.

The apparatus further comprises the typical components present in apparatus suitable for the treatment of substrates with solid particulate material, preferably in a liquid medium and/or in combination with one or more treatment formulation(s) as described in more detail hereinbelow. Thus, the apparatus preferably comprises at least one pump for circulation of the liquid medium, and associated ports and/or piping and/or ducting for transport of the liquid medium and/or one or more treatment formulation(s) into the apparatus, into the drum, out of the drum, and out of the apparatus. Preferably, the apparatus comprises a suitable drive means to effect rotation of the drum, and suitably a drive shaft to effect rotation of the drum. Preferably, the apparatus comprises heating means for heating the liquid medium. Preferably, the apparatus comprises mixing means to mix the liquid medium with one or more treatment formulation(s). The apparatus may further comprise one or more spray means to apply a liquid medium and/or one or more treatment formulation(s) into the interior of the drum and onto the substrate during the treatment thereof.

The apparatus typically further comprises an external casing, which surrounds the tub and drum.

It will be appreciated that the apparatus suitably further comprises a control means programmed with instructions for the operation of the apparatus according to at least one treatment cycle. The apparatus suitably further comprises a user interface for interfacing with the control means and/or apparatus.

The apparatus preferably comprises said solid particulate material.

Valve and Dispensing Aperture

The valve may be actuatable between said closed position and said open position via any appropriate arrangement. When the valve is in the closed position, solid particulate material is prevented from passing through the dispensing aperture. In this way, when the valve is in the closed position, the drum can be rotated in a clockwise direction and in a counter-clockwise direction without any solid particulate material being released from said storage means. When the valve is in said open position, solid particulate material is permitted to pass through said dispensing aperture.

Preferably, the valve may be actuatable between said closed position and a plurality of open positions. For instance, the valve may be actuated to a first open position where solid particulate material is permitted to pass through said dispensing aperture but where the position of said valve relative to said dispensing aperture allows a relatively low rate of dispensing of solid particulate material. The valve may additionally be actuated to a second open position where solid particulate material is permitted to pass through said dispensing aperture but where the position of said valve relative to said dispensing aperture allows a relatively high rate of dispensing of solid particulate material. It will be appreciated that adjustment of the rate of dispensing of said solid particulate material may be achieved by actuating said valve between a plurality of open positions.

Preferably, the valve is actuatable between said closed position and said open position via a shaft, such as a rod. Preferably, the shaft sits within and is aligned with a drive shaft of the drum.

Preferably, said shaft is substantially aligned with the rotational axis of said drum. In this context, the term "substantially aligned" means that the shaft makes an angle with the rotational axis of the drum which is less than about 20°, preferably less than about 10°, preferably less than about 5°. Preferably, the shaft is co-axial with the rotational axis of the drum.

The valve may be manually actuatable. For instance, a user of the apparatus may be able to push in and pull out one end of a shaft and thereby move the valve between the open and closed positions.

Alternatively, or in addition, said valve may be mechanically actuatable.

Preferably, said valve is electromechanically actuatable, in particular using a solenoid or a lead screw. The valve may be actuated remotely, for example, using a magnetic field or using a wireless signal.

Preferably, said valve is actuated using a lead screw, also known as a power screw or translation screw. Lead screws are able to translate rotational motion into linear motion. An advantage of actuating said valve using a lead screw is that the valve can be more readily actuated incrementally and/or intermittently. Furthermore, using a lead screw to actuate the valve may allow less power to be consumed because, typically, once the lead screw has been used to actuate the valve, power can be turned off and the valve will stay where it is positioned.

The valve may be any suitable size and shape such that it is able to prevent solid particulate material from passing through said dispensing aperture when the valve is in said closed position and is able to permit solid particulate material to pass through said dispensing aperture when said valve is in said open position.

Preferably, said valve is configured such that when said valve is in said open position, the minimum dimension of the opening created between said valve and said dispensing aperture is at least 2 times, preferably at least 3 times, more preferably at least 4 times the longest dimension of the solid particulate material. Typically, when said valve is in said open position, the opening created between said valve and said dispensing aperture is at least 5 mm, preferably at least 6 mm, preferably at least 7 mm, preferably at least 8 mm, preferably at least 9 mm, preferably at least 10 mm, preferably at least 11 mm, preferably at least 12 mm, preferably at least 13 mm, preferably at least 14 mm, preferably at least 15 mm, preferably at least 20 mm, preferably at least 25 mm, preferably at least 30 mm. Typically, when said valve is in said open position, the opening created between said valve and said dispensing aperture has a maximum dimension of no more than 200 mm, preferably no more than 100 mm, preferably no more than 50 mm.

Typically, said valve abuts an edge of said dispensing aperture or a surface of said end wall of said drum, to create a seal when said valve is in the closed position. For instance said valve may comprise a disk portion and a shank portion and said disk portion may form a seal with a surface of said end wall of said drum, preferably a substantially vertical surface of said end wall of said drum, when said valve is in said closed position. Alternatively, said disk portion may have a tapered edge and said dispensing aperture may comprise a corresponding tapered edge such that when the valve is in the closed position, said tapered edge of said disk portion of said valve abuts said corresponding tapered edge of said dispensing aperture to create a seal. Preferably, the tapered edge of the disk portion and/or the dispensing aperture is shaped such that accumulation or retention of solid particulate material, which could otherwise prevent closure of the valve, is discouraged. For instance, the tapered edge of the disk portion and/or the dispensing aperture may be angled with respect to the horizontal plane. Preferably, said angle is at least 45°, preferably at least 60°, preferably at least 70°, preferably at least 80° with respect to the horizontal plane. For curved tapered edges, the angle is taken at the midpoint of the curved edge.

Alternatively, said valve may be configured such that when the valve is in the closed position, it does not form a seal with an edge of said dispensing aperture or a surface of said end wall of said drum. Preferably, there is a gap between said valve and said dispensing aperture or said valve and a surface of said end wall of said drum, preferably a substantially vertical surface of said end wall of said drum, when the valve is in the closed position, wherein the size of the gap is such that solid particulate material cannot pass through. Typically, the longest dimension of the gap is less than 2 mm, preferably less than 1 mm. An advantage of having a gap between the valve and an edge of the dispensing aperture or a surface of said end wall of said drum when the valve is in the closed position is that the risk of solid particulate material causing a jamming of the valve can be reduced.

Preferably, said valve projects towards the interior of said drum when said valve is in the open position. Alternatively, preferably said valve moves away from the interior of said drum when said valve is in the open position, preferably said valve moves into said storage means. Preferably, said valve may be or form part of a poppet valve or a spring valve. Preferably, said valve is or forms part of a poppet valve.

Alternatively, said valve may be or form part of a sleeve valve. Typically, said sleeve valve comprises a cylindrical portion having a side comprising at least one port. Preferably, said sleeve valve is configured such that, on rotation, said at least one port can align with an opening in said storage means, thereby permitting passage of solid particulate material from said storage means and through said dispensing aperture into the interior of said drum.

Preferably, said dispensing aperture is located substantially centrally in said end wall of said drum. In this way, solid particulate material that passes through said dispensing aperture from said storage means to said interior of said drum may be more efficiently mixed with said substrate being treated. In particular, this arrangement may increase the amount of solid particulate material that can fall on to the top of said substrate in said interior of said drum.

Preferably, said dispensing aperture coincides with the rotational axis of said drum. Preferably, said dispensing aperture is concentric with the rotational axis of said drum. Preferably, the shape of said dispensing aperture is substantially circular or annular.

Preferably, said dispensing aperture has a minimum dimension of at least 5 mm, preferably at least 6 mm, preferably at least 7 mm, preferably at least 8 mm, preferably at least 9 mm, preferably at least 10 mm, preferably at least 11 mm, preferably at least 12 mm, preferably at least 13 mm, preferably at least 14 mm, preferably at least 15 mm, preferably at least 20 mm, preferably at least 25 mm, preferably at least 30 mm. Preferably, said dispensing aperture has a maximum dimension of no more than 300 mm, preferably no more than 200 mm, preferably no more than 100 mm, preferably no more than 50 mm. Preferably, said dispensing aperture has a minimum dimension that is at least 2 times, preferably at least 3 times, more preferably at least 4 times the longest dimension of the solid particulate material. Preferably, said dispensing aperture has a maximum dimension that is no more than 50% of the diameter of the drum, preferably no more than 25% of the diameter of the drum, preferably no more than 20% of the diameter of the drum.

Preferably, the apparatus comprises a single dispensing aperture. In arrangements where said storage means comprises multiple compartments as described hereinbelow, said single dispensing aperture is preferably in fluid communication with each of said multiple compartments.

However, in alternative embodiments, said drum may comprises a plurality of said dispensing apertures, for instance, 2, 3, 4, 5, or 6 dispensing apertures. For instance, where said storage means comprises multiple compartments as described hereinbelow, each of said plurality of dispensing apertures may be in fluid communication with a separate one of said multiple compartments.

Where the drum comprises a plurality of dispensing apertures, preferably said drum comprises a single valve. In this arrangement, said single valve is configured to interact with said plurality of dispensing apertures in order to prevent solid particulate material from passing through all of said plurality of dispensing apertures when said valve is in said closed position and to permit said solid particulate material to pass through any of said plurality of dispensing apertures when said valve is in said open position.

Alternatively, where the drum comprises a plurality of dispensing apertures, said drum may comprise a plurality of said valves. For instance, the drum may comprise a corresponding number of valves as dispensing apertures.

In arrangements where the apparatus comprises a plurality of valves, said plurality of valves may be independently actuatable. Alternatively, said plurality of valves may be jointly actuatable, for instance by using an arrangement of mechanical linkages positioned inside the storage means. Preferably, said plurality of valves are jointly actuatable by using an arrangement comprising an articulated rod. Having said plurality of valves being jointly actuatable may be advantageous because the number of seals required between the actuating means and the drum can be reduced.

Preferably, said drum comprises a baffle or deflector for regulating the flow of solid particulate material through said dispensing aperture. Preferably, said drum comprises a baffle or deflector configured to bias said solid particulate material within said storage means towards said dispensing aperture.

When said storage means comprises multiple compartments as described hereinbelow, preferably each compartment comprises a baffle or deflector or a portion of said baffle or deflector. Said drum may comprise a baffle or deflector that is in fluid communication with more than one compartment. For instance, said drum may comprise a single baffle or deflector that is in fluid communication with each of said multiple compartments. Alternatively, each of said multiple compartments may comprise a separate baffle or deflector.

Typically, when the valve is in said open position, solid particulate material passes through the dispensing aperture (s) under gravity as the drum rotates. In particular, as the drum rotates, solid particulate material in a cavity or compartment of the storage means may be rotated above the location of the dispensing aperture(s) and can fall under gravity towards, and preferably through, the dispensing aperture.

Preferably, the apparatus further comprises a guard positioned between the interior of said drum and said valve, wherein said guard comprises a plurality of apertures, wherein the plurality of apertures permit passage of solid particulate material through said guard but prevent passage of said substrates. In this way, the apparatus can prevent damage of the substrates being treated by avoiding them coming into contact with said valve and said dispensing aperture.

Preferably, said guard comprises a grill.

Collecting Means

Typically, the drum further comprises collecting means to facilitate flow of solid particulate material from the interior of said drum to said storage means. Said collecting means may take a variety of forms and the drum may comprise collecting means at one or more locations.

For instance, said end wall of said drum may comprise at least one collecting aperture to facilitate flow of said solid particulate material from the interior of said drum to said storage means, wherein preferably said at least one collecting aperture is adjacent the periphery of the end wall of said drum. In such an arrangement, the apparatus is preferably configured such that for at least a part of said treatment said drum is tilted such that its axis defines an angle α to the horizontal plane which is greater than 0 and less than about 10° and such that said drum is inclined in a downwards direction from the front of said drum to the end wall of said drum. In this way, solid particulate material in the interior of said drum can be biased towards the said at least one collecting aperture adjacent the periphery of the end wall of said drum.

Alternatively, said drum may comprise an elongate protrusion located on said inner surface of said drum, wherein said elongate protrusion extends in a direction away from said end wall, wherein said elongate protrusion has an end proximal to the end wall and an end distal to the end wall.

Preferably, said elongate protrusion comprises a collecting aperture and a collecting flow path to facilitate flow of said particulate material from the interior of said drum to said storage means, wherein said collecting aperture in the elongate protrusion defines the start of said collecting flow path, and wherein said flow of said solid particulate material from the interior of the drum towards the storage means is facilitated by the rotation of said drum in a collecting direction.

Preferably, said elongate protrusion comprises:

(a) a first collecting flow path to facilitate flow of said solid particulate material from the interior of said drum to a storage means in said drum when said drum rotates in a first collecting direction, and (b) a second collecting flow path to facilitate flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

Typically, said elongate protrusion comprises said first collecting flow path and further comprises a first collecting aperture, wherein said first collecting aperture defines the start of said first collecting flow path.

Said elongate protrusion located on the inner surface of the drum in the apparatus of the present invention is a type of "lifter". Lifters are used in conventional apparatus, as well as in apparatus adapted for the treatment of substrates using solid particulate material, to encourage circulation and agitation of the contents (i.e. the substrate(s), treatment agents and solid particulate material) within the drum during rotation of the drum.

Typically, said elongate protrusion is disposed on the inner surface of the drum such that the elongate dimension of the protrusion is essentially perpendicular to the direction of rotation of the drum.

Preferably, said first collecting aperture is disposed in a first side of said elongate protrusion, wherein said first side of said elongate protrusion is the leading side of said elongate protrusion during rotation of the drum in said first collecting direction.

Said elongate protrusion may comprise a plurality of said first collecting apertures disposed in said first side of said elongate protrusion at a plurality of positions from the proximal end to the distal end thereof. Typically, there may be from about 2 to about 200, from about 3 to about 100, from about 4 to about 50, from about 5 to about 30, from about 6 to about 25, or from about 10 to about 20 first collecting apertures disposed on said first side of said elongate protrusion. For domestic washing machines, preferably there are from about 5 to about 15 first collecting apertures disposed on said first side of said elongate protrusion. For commercial substrate treatment machines, preferably there are from about 5 to about 100 first collecting apertures disposed on said first side of said elongate protrusion.

Said first collecting aperture(s) may be any suitable size and shape to allow ingress of solid particulate material into said first collecting flow path. Typically, the shape of said first collecting aperture(s) is substantially rectangular, substantially circular, substantially square or substantially oval in shape. Preferably, the shape of said first collecting aperture(s) is substantially rectangular. Preferably, the first collecting aperture(s) is positioned in order that entry of said solid particulate material from the interior of said drum to the first collecting flow path is as free-flowing as possible. Preferably, the first collecting aperture(s) is adjacent the inner surface of said drum. Typically, said elongate protrusion comprises an arrangement of a plurality of first collecting apertures such that substantially the entire length of the first side of said elongate protrusion from the proximal end to the distal end comprises first collecting apertures. Preferably, each aperture is separated from its neighbour or neighbours by a distance of about 10 mm or less, about 8 mm or less, about 5 mm or less, about 3 mm or less or about 1 mm or less. Preferably, the first collecting apertures comprise from about 50 to about 95%, preferably from about 60 to about 90% of the length of the first side of said elongate protrusion. Having an arrangement with a plurality of closely spaced first collecting apertures allows for efficient collection (also known as "harvesting") of solid particulate material from the interior of said drum. In particular, such an arrangement advantageously increases the opportunities for solid particulate material in the interior of the drum to strike a first collecting aperture when the drum is rotated in said first collecting direction and thus allows for ingress of said solid particulate material into said first collecting flow path.

Preferably the first side of said elongate protrusion is adapted to bias solid particulate material towards said first collecting aperture(s).

For instance, said first collecting aperture(s) may have a funnel shape to increase the cross-sectional area at the entry to said first collecting flow path and thereby increase the probability of entry of solid particulate material into said first collecting flow path.

Additionally or alternatively, the region between adjacent first collecting apertures may be angled towards a collecting aperture, thereby encouraging solid particulate material to enter the collecting flow path.

Optionally, said elongate protrusion may comprise a collecting groove along at least part of said first side, wherein the collecting groove is configured to collect solid particulate material during rotation in said first collecting direction, whereupon the solid particulate material is biased towards said first collecting aperture(s) during further rotation in said first collecting direction. Such a collecting groove is preferably disposed in said elongate protrusion along at least part of the edge of said elongate protrusion where it meets the inner wall of the drum.

Preferably, said elongate protrusion is configured to bias solid particulate material in said first collecting flow path towards the storage means during rotation of the drum in said first collecting direction. Preferably, said elongate protrusion is further configured to prevent, more preferably to eliminate, solid particulate material present in said first collecting flow path from returning to the interior of said drum when the drum rotates in said second collecting direction. For instance, said elongate protrusion may comprise one or more flap, paddle, gate or combination thereof that adopts an open position that permits solid particulate material in the first collecting flow path moving towards the storage means when the drum is rotating in said first collecting direction but adopts a closed position that prevents solid particulate material from re-entering the interior of said drum when the drum is rotating in said second collecting direction.

More preferably, said elongate protrusion is configured to bias solid particulate material in said first collecting flow path towards the storage means during rotation of the drum in both said first collecting direction and in said second collecting direction. In this way, solid particulate material that has entered said first collecting flow path is able to continue to move towards the storage means even when the direction of rotation of the drum is reversed. This arrangement significantly reduces, and preferably completely eliminates, the amount of solid particulate material that re-enters the interior of the drum from said first collecting flow path when the direction of rotation of the drum is reversed. For instance, said elongate protrusion may comprise an arrangement of deflectors that urges solid particulate material towards the storage means regardless of the direction of rotation of said drum.

Said elongate protrusion further comprises said second collecting flow path and a second collecting aperture, wherein said second collecting aperture defines the start of said second collecting flow path. In this arrangement, said elongate protrusion comprises both said first collecting flow path and said second collecting flow path. In this way, said elongate protrusion is able to collect solid particulate material regardless of the direction of rotation of the drum. As such, this arrangement of the elongate protrusion may also be known as a "bidirectional elongate protrusion" or a "bidirectional lifter".

Said second collecting aperture may be disposed in a second side of said elongate protrusion, wherein said second side of said elongate protrusion is the leading side of said elongate protrusion during rotation of the drum in said second collecting direction.

Said elongate protrusion may comprise a plurality of said second collecting apertures disposed in said second side of said elongate protrusion at a plurality of positions from the proximal end to the distal end thereof. Typically, there may be from about 2 to about 200, from about 3 to about 100, from about 4 to about 50, from about 5 to about 30, from about 6 to about 25, or from about 10 to about 20 second collecting apertures disposed on said second side of said elongate protrusion. For domestic washing machines, preferably there are from about 5 to about 15 second collecting apertures disposed on said second side of said elongate protrusion. For commercial substrate treatment machines, preferably there are from about 5 to about 100 second collecting apertures disposed on said second side of said elongate protrusion.

Said second collecting aperture(s) may be any suitable size and shape to allow ingress of solid particulate material into said second collecting flow path. Typically, the shape of said second collecting aperture(s) is substantially rectangular, substantially circular, substantially square or substantially oval in shape. Preferably, the shape of said second collecting aperture(s) is substantially rectangular. Preferably, the second collecting aperture(s) is positioned in order that entry of said solid particulate material from the interior of said drum to the second collecting flow path is as free-flowing as possible. Preferably, the second collecting aperture(s) is adjacent the inner surface of said drum. Typically, said elongate protrusion comprises an arrangement of a plurality of second collecting apertures such that substantially the entire length of the second side of said elongate protrusion from the proximal end to the distal end comprises second collecting apertures. Preferably, each aperture is separated from its neighbour or neighbours by a distance of about 10 mm or less, about 8 mm or less, about 5 mm or less, about 3 mm or less or about 1 mm or less. Preferably, the second collecting apertures comprise from about 50 to about 95%, preferably from about 60 to about 90% of the length of the second side of said elongate protrusion. Having an arrangement with a plurality of closely spaced second collecting apertures allows for efficient collection (also known as "harvesting") of solid particulate material from the interior of said drum. In particular, such an arrangement advantageously increases the opportunities for solid particulate material in the interior of the drum to strike a second collecting aperture when the drum is rotated in said second colleting direction and thus allows for ingress of said solid particulate material into said second collecting flow path.

Preferably the second side of said elongate protrusion is adapted to bias solid particulate material towards said second collecting aperture(s).

For instance, said second collecting aperture(s) may have a funnel shape to increase the cross-sectional area at the entry to said second collecting flow path and thereby increase the probability of entry of solid particulate material into said second collecting flow path.

Additionally or alternatively, the region between adjacent second collecting apertures may be angled towards a collecting aperture, thereby encouraging solid particulate material to enter said second collecting flow path.

Optionally, said elongate protrusion may comprise a collecting groove along at least part of the second side, wherein the collecting groove is configured to collect solid particulate material during rotation in said second collecting direction, whereupon the solid particulate material is biased towards the second collecting aperture(s) during further rotation in said second collecting direction. Such a collecting groove is preferably disposed in said elongate protrusion along at least part of the edge of said elongate protrusion where it meets the inner wall of the drum.

Preferably, said elongate protrusion is configured to bias solid particulate material in said second collecting flow path towards the storage means during rotation of the drum in said second collecting direction. Preferably, said elongate protrusion is further configured to prevent, more preferably to eliminate, solid particulate material present in said second collecting flow path from returning to the interior of said drum when the drum rotates in said first collecting direction. For instance, said elongate protrusion may comprise one or more flap, paddle, gate or combination thereof that adopts an open position that permits solid particulate material in said second collecting flow path moving towards the storage means when the drum is rotating in said second collecting direction but adopts a closed position that prevents solid particulate material from re-entering the interior of said drum when the drum is rotating in said first collecting direction.

More preferably, said elongate protrusion is configured to bias solid particulate material in said second collecting flow path towards the storage means during rotation of the drum in both said first collecting direction and in said second collecting direction. In this way, solid particulate material that has entered said second collecting flow path is able to continue to move towards the storage means even when the direction of rotation of the drum is reversed. This arrangement significantly reduces, and preferably completely eliminates, the amount of solid particulate material that re-enters the interior of the drum from said second collecting flow path when the direction of rotation of the drum is reversed. For instance, said elongate protrusion may comprise an arrangement of deflectors that urges solid particulate material towards the storage means regardless of the direction of rotation of said drum.

Typically, said elongate protrusion is rectilinear in shape.

Preferably, said first collecting flow path and said second collecting flow path are symmetrically arranged along the length of said elongate protrusion.

Preferably, said elongate protrusion comprises a first lengthwise portion and a second lengthwise portion. Preferably, said first lengthwise portion and said second lengthwise portion are symmetrically arranged along the length of said elongate protrusion.

Solid particulate material that is in the first collecting flow path is preferably urged along said first lengthwise portion towards said storage means as said drum rotates in said first collecting direction. Preferably, when said drum rotates in said second collecting direction, said solid particulate material in said first collecting flow path may transfer to said second lengthwise portion and be urged towards said storage means as said drum rotates in said second collecting direction. Similarly, solid particulate material that is in the second collecting flow path is preferably urged along said second lengthwise portion towards said storage means as said drum rotates in said second collecting direction. Preferably, when said drum rotates in said first collecting direction, said solid particulate material in said second collecting flow path may transfer to said first lengthwise portion and be urged towards said storage means as said drum rotates in said first collecting direction.

Preferably, said elongate protrusion comprises a barrier projecting from a base portion of said elongate protrusion adjacent the inner surface of said drum, wherein said barrier extends at least partially towards a top portion of said elongate protrusion, wherein said barrier at least partially separates said first lengthwise portion from said second lengthwise portion. Solid particulate material that enters said elongate protrusion by a first collecting aperture is urged to follow said first collecting flow path as the drum rotates, whereas solid particulate material that enters said elongate protrusion by a second collecting aperture is urged to follow said second collecting flow path as the drum rotates.

Preferably, said elongate protrusion is configured such that solid particulate material that is in the first collecting flow path is able to move over the top of said barrier into said second lengthwise portion when the drum changes rotation direction from said first collecting direction to said second collecting direction. Preferably, said elongate protrusion is configured such that solid particulate material that is in the second collecting flow path is able to move over the top of said barrier into said first lengthwise portion when the drum changes rotation direction from said second collecting direction to said first collecting direction.

Preferably, said first side and/or said second side of said elongate protrusion is inclined so that the width of said elongate protrusion is narrower at a top portion of said elongate protrusion than at a base portion of the elongate protrusion adjacent the inner surface of said drum.

The apparatus of the present invention preferably comprises a plurality of said elongate protrusions. The drum preferably has from 2 to 10, preferably 2, 3, 4, 5 or 6 and preferably 2, 3 or 4, and preferably 3 or 4, of said elongate protrusions. For domestic washing machines, 3 protrusions are most preferred. For commercial washing machines, 4, 5 or 6 protrusions, and preferably 6 protrusions, are most preferred. Where a plurality of elongate protrusions are located on the inner surface of the drum, all of the elongate protrusions typically have the same or substantially the same dimensions as each other. In alternative embodiments, a plurality of elongate protrusions may have elongate protrusions of differing dimensions, i.e. one or more elongate protrusions of a first size and/or shape, and one or more elongate protrusions of a second size and/or shape, etc.

A first collecting flow path is defined as a flow path of solid particulate material from a first collecting aperture to the storage means. A first collecting aperture defines the start of a first collecting flow path. Solid particulate material enters said first collecting flow path from the interior of the drum via a first collecting aperture. A first collecting flow path is in fluid communication with the storage means, and preferably there is no valve separating a first collecting flow path and the storage means.

Similarly, a second collecting flow path is defined as a flow path of solid particulate material from a second collecting aperture to the storage means. A second collecting aperture defines the start of a second collecting flow path. Solid particulate material enters said second collecting flow path from the interior of the drum via a second collecting aperture.

A second collecting flow path is in fluid communication with the storage means, and preferably there is no valve separating a second collecting flow path and the storage means.

Preferably, whether solid particulate material is in said first collecting flow path or said second collecting flow path is determined by the collecting aperture through which the solid particulate material entered. For instance, solid particulate material that enters through a first collecting aperture travels to the storage means via said first collecting flow path, and solid particulate material that enters through a second collecting aperture travels to the storage means via said second collecting flow path.

Preferably, said first collecting flow path and/or said second collecting flow path comprises a series of deflectors which are configured to urge said solid particulate material towards said storage means during rotation of said drum. Preferably, said first collecting flow path and/or said second collecting flow path further comprises a plurality of series of deflectors which are configured to urge said solid particulate material towards said storage means during rotation of said drum. Preferably, said first collecting flow path and/or said second collecting flow path comprises a first series of deflectors which are configured to urge said solid particulate material towards said storage means during rotation of said drum and a second series of deflectors which are configured to urge said solid particulate material towards said storage means during rotation of said drum. Preferably said first lengthwise portion and said second lengthwise portion of said first embodiment of said elongate protrusion and/or said lifter comprise a series of deflectors or a plurality of series of deflectors as described herein Preferably, said series of deflectors, or each series of said plurality of series of deflectors, are inclined substantially parallel to each other. In this context, the term "substantially parallel" means that the respective deflectors make an angle with each other which is less than about 20°, preferably less than about 10°, preferably less than about 5°. Preferably, a series of deflectors in a plurality of series of deflectors are inclined substantially parallel to each other but are not substantially parallel to deflectors in other series of deflectors.

Preferably, said first collecting flow path and/or said second collecting flow path comprises a chain of open compartments which are configured to urge said solid particulate material towards said storage means during rotation of said drum. Preferably said first lengthwise portion and said second lengthwise portion of said elongate protrusion and/or said lifter comprise a chain of open compartments which are configured to urge said solid particulate material towards said storage means during rotation of said drum.

Preferably, said first collecting flow path and/or said second collecting flow path is or comprises an Archimedean screw arrangement. Preferably, said first lengthwise portion and said second lengthwise portion of said elongate protrusion and/or said lifter comprise an Archimedean screw arrangement. Typically, said Archimedean screw arrangement may comprise surfaces that are rectilinear or curvilinear or a combination thereof.

In a preferred embodiment, said first and second collecting flow path is or comprises an Archimedean screw arrangement which is located in said elongate protrusion or said lifter of the invention. As the drum is rotated in the collecting direction, the solid particulate material within said first and/or second collecting flow path is urged by the internal surfaces of the Archimedean screw along the collecting flow path and towards the storage means. Thus, as a result only of the rotation of the drum, the solid particulate material may be conveyed from the collecting aperture and/or collecting flow path to the storage means.

Preferably, the elongate protrusion or said lifter comprises a pair of Archimedean screws, wherein the Archimedean screws are oppositely handed, that is, one of the pair of Archimedean screws has a clockwise path whereas the other pair of Archimedean screws has a counter-clockwise path.

Preferably, each screw pitch of said Archimedean screw arrangement is associated with a first or a second collecting aperture. Similarly, each open compartment in said chain of open compartments is associated with a first or a second collecting aperture.

Where said elongate protrusion has a plurality of collecting apertures, preferably said elongate protrusion comprises a plurality of corresponding collecting flow paths. For instance, each of said first collecting flow paths starts at one of said plurality of first collecting apertures and then unites with other first collecting flow paths to form a single common first collecting flow path in said elongate protrusion or said lifter, wherein said single common first collecting flow path is in fluid communication with said storage means. Preferably, said single common first collecting flow path comprises a chain of open compartments or Archimedean screw arrangement as described herein. Preferably, each of said second collecting flow paths starts at one of said plurality of second collecting apertures and then unites with other second collecting flow paths to form a single common second collecting flow path in said first and/or second elongate protrusion or lifter, wherein said single common second collecting flow path is in fluid communication with said storage means. Preferably, said single common second collecting flow path comprises a chain of open compartments or Archimedean screw arrangement as described herein.

Preferably, one of said first or second collecting flow paths is or comprises a substantially clockwise path and the other of said first and second collecting flow paths is or comprises a substantially counter-clockwise path.

In the apparatus of the present invention, a first collecting flow path and a second collecting flow path are different flow paths. The first collecting flow path and the second collecting flow path may be partially but not completely coextensive. In other words, a portion (but not the entirety) of a first collecting flow path may occupy the same space as a portion of a second collecting flow path.

Preferably, said first and second collecting flow paths are constituted by the walls of a series of separate modular sections wherein each of said modular sections comprises a collecting aperture and a portion of said first and/or second collecting flow paths, wherein said series of separate modular sections, when joined together, form at least some of the boundary walls of said first and second collecting flow paths. Preferably, said modular sections form the internal walls of said first and/or second elongate protrusion, i.e. the walls of said first and/or second collecting flow paths, rather than the outer walls of the elongate protrusion which contact the substrates in the interior of the drum. A modular arrangement has the advantage of easier and more economic manufacturing, for instance by injection moulding. Preferably the modular sections in this embodiment are joined together linearly, preferably by means of a tie-bar which extends from the first to the last modular section. The assembly comprising the tie-bar and joined modular sections are suitably covered by the outer skin of the elongate protrusion (typically a stainless steel outer skin), which extends from the proximate end to the distal end thereof. Thus, the tie bar is suitably located within said first and/or second elongate protrusion, or lifter, preferably within the lobe which is most remote from the inner surface of the drum, or juxtaposed with the trailing edge of the elongate protrusion or lifter during rotation of the drum in a collecting direction.

Said Archimedean screw may be motorised but preferably the inner surfaces of the Archimedean screw are static, relative to the inner wall of the drum, i.e. the inner surfaces of the Archimedean screw preferably do not rotate independently of the rotation of the drum.

The inner surfaces of the Archimedean screw suitably have a conventional circular and/or smooth arrangement. Alternatively or additionally, the Archimedean screw is rectilinear, having stepped surfaces along at least a part of its length. Similarly, while the cross-section of an Archimedean screw is suitably circular, other cross-sections are envisaged, and particularly multi-lobal cross-sections, such as tri-lobal or quadri-lobal. A trilobal cross-section is of particular utility because the elongate protrusions within which the Archimedean screw is disposed are typically triangular in cross-section; hence a trilobal cross-section for the Archimedean screw makes the best possible use of the space available inside the elongate protrusion. Rectilinear arrangements are of particular utility because the elongate protrusion, or lifter, may be manufactured in multiple pieces and assembled together to form the flow paths discussed hereinabove in said elongate protrusion, second elongate protrusion or lifter. Suitable manufacturing processes include injection moulding.

In another preferred embodiment, referred to herein as the paternoster configuration, said chain of open compartments are formed by a first series of inclined vanes substantially parallel to each other and a second series of inclined vanes substantially parallel to each other. In this context, the term "substantially parallel" means that the respective vanes make an angle with each other which is less than about 20°, preferably less than about 10°, preferably less than about 5°.

Preferably, said first and second series are disposed along at least part of the length of the interior of said first and/or second elongate protrusion or lifter. Said first series of vanes may be disposed in a facing arrangement to said second series of vanes, wherein said first series of vanes are not parallel to said second series of vanes, and wherein the compartments and vanes are configured to bias solid particulate material present inside said first and/or second collecting flow path towards said storage means during rotation of the drum in a first and/or second collecting direction.

In a further preferred embodiment, said chain of open compartments is formed by opposing and offset saw-tooth surfaces configured to bias solid particulate material present inside said first and/or said second collecting flow path towards said storage means during rotation of the drum.

Optionally, said elongate protrusion, said second elongate protrusion and/or said lifter may comprise one or more perforations which have dimensions smaller than the smallest dimension of the solid particulate material so as to permit passage of fluids through said perforations but to prevent passage of said solid particulate material through said perforations.

Preferably, movement of said solid particulate material between the interior of the drum and the storage means is actuated entirely by rotation of the drum. It will be appreciated that the term "actuated entirely by rotation of the drum" means that said movement of said particulate material is effected by the rotation of the drum and also affected by gravity. In particular, it will be appreciated that the term "actuated entirely by rotation of the drum" means that said movement of said solid particulate material between the storage means and the interior of the drum does not require a pump.

Storage Means

The storage means may take a variety of forms and the drum may comprise storage means at one or more locations.

In a preferred embodiment, the storage means comprises multiple compartments, for instance, 2, 3, 4, 5 or 6 compartments, particularly wherein said multiple compartments are arranged so as to retain balance of the drum during rotation, preferably such that said multiple compartments are equi-spaced and arranged symmetrically around the rotational axis of the drum.

The capacity of the storage means will vary with the size of the drum and the amount of solid particulate material. Preferably the capacity of the storage means is from about 20 to about 50%, preferably from about 30 to about 40%, larger than the volume of the solid particulate material. In this context, the term "volume of solid particulate material" preferably refers to the volume occupied by solid particulate material when packed randomly (i.e. including the spaces around each particle of the multiplicity of particles when in packed form in the storage means). Thus, a washing machine for domestic use would typically require about 8 litres of solid particulate material, and an appropriate storage means for such a machine has a capacity of about 11 litres.

In one particularly useful embodiment, the storage means, the dispensing aperture, the valve, and optionally the elongate protrusion(s), can be assembled together inside the drum and/or are able to be retrofitted to an existing drum. This arrangement is of particular utility in converting a conventional apparatus which is not suitable or adapted for the treatment of substrates using a solid particulate material into an apparatus which is suitable for the treatment of substrates using a solid particulate material. In this embodiment, the storage means, the dispensing aperture, the valve (and the optional elongate protrusion(s)) would normally be non-integral elements, in order to allow these components to be introduced into the drum without dissembling the whole apparatus, for instance in order to introduce the components through the access means. However, integral storage means, dispensing aperture, valve and/or elongate protrusion(s) are also envisaged.

In a further particularly useful embodiment, the storage means, the dispensing aperture and the valve (and, where present, the optional elongate protrusion(s)) are removable and replaceable, either by the consumer or by a service engineer. In this embodiment, the storage means, the dispensing aperture and the valve (and the optional elongate protrusion(s)) would normally be non-integral elements, in order to allow these components to be introduced into the drum without dissembling the whole apparatus. However, integral storage means, dispensing aperture, valves and/or elongate protrusion(s) are also envisaged. One advantage of this embodiment is that it can allow convenient replacement of the solid particulate material. Thus, solid particulate material located within the storage means and/or elongate protrusions may be removed at the same time as the storage means and/or elongate protrusions, and replaced with fresh solid particulate material contained in the replacement storage means. Alternatively, solid particulate material may be replaced by operating the apparatus (normally by a cycle determined by pre-programmed instructions stored in the control means of the apparatus) such that solid particulate material is dispensed into an empty drum by rotating the drum in the manner described herein, and then manually removed by a service engineer, wherein fresh solid particulate material is then manually loaded into the empty drum by a service engineer and the apparatus then operated (normally by a cycle determined by pre-programmed instructions stored in the control means of the apparatus) such that solid particulate material is collected from the drum and passed into the storage means via collecting means, such as the elongate protrusions described herein by rotating the drum in the manner described herein. Thus, it is not necessary to replace the storage means just to replace the solid particulate material.

At least part of (and preferably all of) the storage means is or comprises at least one cavity located in the end wall of the drum. It will be appreciated that the term "located in the end wall of the drum" describes a storage means which is integral with, or affixed or disposed on, any part of the structure of the end wall. Thus, in the retro-fitting embodiment described herein, the storage means are disposed or affixed onto the existing end wall of an existing drum. The outer surface of the retrofitted storage means which faces towards the interior of the drum thus creates a new interior surface, which is different to the original interior surface of the original end wall prior to retro-fitting, but it will be appreciated that this new interior surface is treated for the purposes of this invention as being the interior surface of the new end wall of the drum. In other words, the retro-fitted storage means becomes part of the element which is described herein as the "end wall of the drum". Similarly, storage means may be also present on or retro-fitted to the exterior surface of an end wall of the drum which faces the casing of the apparatus, and for the purposes of the present invention such a storage means is also treated as "located in the end wall of the drum". Thus, it will be appreciated also that, in relation to said dispensing aperture, the term "comprised in the end wall of the drum" describes a dispensing aperture which is comprised in the element which is described herein as the "end wall of the drum".

Thus, the storage means may be or comprise at least one spiral or helical pathway located in the end wall of the drum.

The drum may comprise an additional storage means comprising a toroidal cavity located at the juncture of the inner surface and end wall of the drum, or a cavity having a shape defined by a toroidal segment located at the juncture of said inner surface and said end wall. It will be appreciated that such an additional storage means does not fall within the meaning of "located in the end wall of the drum" as used herein.

The storage means may comprise multiple parts, preferably from 2 to 8 parts, and for domestic washing machines preferably 2, 3 or 4 parts, which advantageously can be assembled inside the drum and/or which is able to be retrofitted to an existing drum.

In a most preferred embodiment, the storage means comprises multiple compartments or cavities located in the end wall of the drum, as described above. Preferably, each of the compartments in such a multi-compartment arrangement is defined by a cavity bound by a first wall and a second wall which each extend substantially radially outwards from the rotational axis of the drum towards, and preferably extend to, the inner wall of the drum. The drum is normally cylindrical, and so preferably each compartment substantially defines a sector of a cylindrical storage volume in the end wall of drum. Preferably, each compartment in the multi-compartment arrangement is adjacent another compartment, preferably so that the compartments define adjacent such sectors which fill or substantially fill a cylindrical storage volume in the end wall of drum. As used herein, the terms "extend substantially radially outwards" and "substantially defines a sector" means that said first wall and/or said second wall of said cavity need not follow a straight line defining the mathematical radius, i.e. a straight line extending radially outwards from the rotational axis towards and preferably to the inner wall of the drum, but said first wall and/or said second wall of said cavity may also follow a curvilinear path which extends outwards from the rotational axis of the drum towards and preferably to the inner wall of the drum. Where the drum comprises one or more elongate protrusions as described herein, preferably each compartment in the multi-compartment arrangement is associated with a single elongate protrusion.

In the multi-compartment embodiment, it is preferred that at least one pair of adjacent compartments are in fluid communication. Preferably, each compartment is in fluid communication with its adjacent compartment or compartments. As used herein, the term "fluid communication" means that solid particulate material, as well as any liquid medium, is able to pass from one compartment directly into an adjacent compartment or compartments during rotation of the drum. Such an arrangement advantageously minimises or avoids the tendency for aggregation of solid particulate material which has been contacted with the liquid medium, i.e. it minimises or avoids the tendency of moist or wet solid particulate material to aggregate or clump together in the storage means, which can cause at least partial blockage during dispensing or collection of the solid particulate material. Such an arrangement also provides an improvement in the collection efficiency of the solid particulate material. Such an arrangement advantageously creates more space in the storage means at the point(s) where the storage means meet the collecting and/or dispensing flow paths. Such an arrangement can also advantageously improve the balance of the drum during rotation. The fluid communication between adjacent compartments is preferably effected by an aperture, hereinafter referred to as a communicating aperture, in the wall between adjacent compartments. Such a communicating aperture preferably exhibits a smallest dimension which is at least 4 times greater than the longest dimension of the solid particulate material. The largest dimension of the communicating aperture is suitably appropriate to retain the individual nature of the compartments and, as such, the largest dimension of the communicating aperture is preferably no greater than 50%, preferably no greater than 40%, preferably no greater than 30%, preferably no greater than 20%, preferably no greater than 15%, preferably no greater than 10% of the longest dimension of a wall between adjacent compartments. A communicating aperture is preferably located in a wall between adjacent compartments approximately midway between the rotational axis and the inner wall of the drum. As used herein, the term "approximately midway" means any position along a wall between adjacent compartments that is closer to the mid-point of said wall between adjacent compartments than to either the rotational axis of the drum or the inner wall of the drum. For instance, where each compartment defines a sector of a cylindrical storage volume in the end wall of the drum, the mid-point of a wall between adjacent compartments is half the radius of the drum. Preferably, a communicating aperture in a wall between adjacent compartments is located at said mid-point. Alternatively, preferably said communicating aperture is located in a wall between adjacent compartments at a point that is adjacent the inner wall of the drum, preferably at the periphery of the end wall of the drum.

Preferably, where the storage means comprises multiple compartments, the multiple compartments are in fluid communication with a single dispensing aperture.

Suitably, the storage means further comprises one or more perforations which have dimensions smaller than the smallest dimension of the solid particulate material so as to permit passage of fluids through said perforations into and out of the storage means, particularly from or into the interior of said drum respectively, but to prevent egress of said solid particulate material through said perforations. The presence of such perforations is advantageous for the cleaning and general hygiene of the interior of the storage means.

Where the drum comprises an elongate protrusion having a collecting flow path from a collecting aperture to said storage means, said collecting flow path may comprise a valve, preferably a one-way flap valve, to prevent egress of solid particulate material from the storage means back into said collecting flow path. Advantageously, such a valve helps ensure the storage means is filled as efficiently as possible. The flap valve may be biased with a spring, and/or be mechanically controlled with a cam, and/or be gravity-operated and comprise therein a sufficient weight, in order to prevent egress of solid particulate material from said storage means to a collecting flow path and hence into the interior of the drum.

Where the drum comprises an elongate protrusion having a first collecting flow path and a second collecting flow path as described above (the so called "bidirectional lifter"), said first collecting flow path may comprise a valve, preferably a one-way flap valve, to prevent egress of solid particulate material from the storage means back into said first collecting flow path during rotation of the drum in a second collecting direction. Similarly, said second collecting flow path may comprise a valve, preferably a one-way flap valve, to prevent egress of solid particulate material from the storage means back into said second collecting flow path during rotation of the drum in a first collecting direction. Advantageously, such a valve helps ensure the storage means is filled as efficiently as possible. The flap valve may be biased with a spring, and/or be mechanically controlled with a cam, and/or be gravity-operated and comprise therein a sufficient weight, in order to prevent egress of solid particulate material from said storage means to said first and/or second collecting flow path and hence into the interior of the drum.

Alternatively or in addition, where the drum comprises an elongate protrusion in the form of a bidirectional lifter as defined above, the apparatus of the present invention comprises a delivery duct in fluid communication between said first collecting flow path and/or said second collecting flow path and a compartment of said storage means, wherein said delivery duct is configured to transfer said solid particulate material from said first collecting flow path and/or said second collecting flow path to said compartment of said storage means, preferably such that entry of said solid particulate material into said compartment occurs when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, entry of said solid particulate material into said compartment occurs when at least a portion of said compartment is above the horizontal plane bisecting the axis of drum rotation. As the amount of solid particulate material in a compartment of a storage means increases, the amount of free space remaining in the compartment reduces. As such, it can become increasingly difficult for additional solid particulate material to enter a compartment of a storage means. By having a drum further comprising a delivery duct, as described herein, the flow of solid particulate material into said compartment of said storage means can be regulated. In particular, the delivery duct can enable solid particulate material from said first collecting flow path and/or said second collecting flow path to enter a compartment of said storage means at a point in the rotation of the drum where existing solid particulate material in said compartment has fallen under gravity to a lower region of said compartment and hence facilitates the flow of solid particulate material into remaining empty space in said compartment, typically in an upper region of said compartment.

Preferably, said delivery duct is configured to be located around a portion of the circumference of the end wall of the drum.

Preferably, said delivery duct comprises a first entry aperture and a first exit aperture, wherein the first entry aperture is in fluid communication with said first collecting flow path and/or said second collecting flow path and is configured such that solid particulate material is able to enter the delivery duct through the first entry aperture and pass through the delivery duct as the drum rotates in said first collecting direction before passing through the first exit aperture and into a compartment of the storage means.

Preferably, said delivery duct further comprises a second entry aperture and a second exit aperture, wherein the second entry aperture is in fluid communication with said first collecting flow path and/or said second collecting flow path and is configured such that solid particulate material is able to enter the delivery duct through the second entry aperture and pass through the delivery duct as the drum rotates in said second collecting direction before passing through the second exit aperture and into a compartment of the storage means.

Preferably, said first entry aperture and said second entry aperture are the same aperture. In this way, said delivery duct comprises a common entry aperture for said first collecting flow path and said second collecting flow path.

Preferably, the delivery duct further comprises:

(a) a central portion comprising said first and second entry apertures;

(b) a first arm extending from said central portion in a first direction around the circumference of said end wall to a first end of said delivery duct; and (c) a second arm extending from said central portion in a second direction around the circumference of said end wall to a second end of said delivery duct, wherein said first exit aperture is adjacent said first end and said second aperture is adjacent said second end.

Where said compartment of said storage means is defined by a cavity bound by a first wall and a second wall which each extend substantially radially outwards from the rotational axis of the drum towards, and preferably extend to, the inner wall of the drum, said delivery duct is preferably positioned such that said first exit aperture is adjacent the first wall of the compartment and said second exit aperture is adjacent the second wall of the compartment.

Preferably, said delivery duct comprises a first arrangement of one or more baffles configured to regulate the flow of solid particulate material that nears the first exit aperture of the delivery duct, preferably when said first exit aperture is below the horizontal plane bisecting the axis of drum rotation, as the drum rotates in said first collecting direction, and wherein said first arrangement of one or more baffles is further configured to allow said solid particulate material to pass through the first exit aperture and enter the compartment of the storage means when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, said first arrangement of one or more baffles is configured to allow solid particulate material to pass through the first exit aperture and enter the compartment when the first exit aperture moves above the horizontal plane bisecting the axis of drum rotation as the drum rotates in said first collecting direction.

Preferably, said first arrangement of baffles comprises a first baffle that is configured to discourage, preferably to prevent, solid particulate material that has passed said first baffle when travelling through the delivery duct towards the storage means from returning back towards the first and/or second collecting flow path as the drum rotates in said first collecting direction. Preferably, said first arrangement of baffles comprises a second baffle configured to urge towards said compartment the solid particulate material that has passed said first baffle when the first exit aperture moves above the horizontal plane bisecting the axis of drum rotation as the drum rotates in said first collecting direction.

Preferably, said delivery duct comprises a second arrangement of one or more baffles configured to regulate the flow of solid particulate material that nears the second exit aperture of the delivery duct, preferably when said second exit aperture is below the horizontal plane bisecting the axis of drum rotation, as the drum rotates in said second collecting direction, and wherein the second arrangement of one or more baffles is further configured to allow said solid particulate material to pass through said second exit aperture and enter the compartment of the storage means when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, said second arrangement of one or more baffles is configured to allow solid particulate material to pass through the second exit aperture and enter the compartment when said second exit aperture moves above the horizontal plane bisecting the axis of drum rotation as the drum rotates in said second collecting direction.

Preferably, said second arrangement of baffles comprises a first baffle that is configured to discourage, preferably to prevent, solid particulate material that has passed said first baffle when travelling through the delivery duct towards the storage means from returning back towards the first and/or second collecting flow path as the drum rotates in said second collecting direction. Preferably, said second arrangement of baffles comprises a second baffle configured to urge towards said compartment the solid particulate material that has passed said first baffle when the first exit aperture moves above the horizontal plane bisecting the axis of drum rotation as the drum rotates in said second collecting direction.

Preferably, the drum comprises a plurality of delivery ducts. Preferably, each elongate protrusion as defined herein that is affixed to the inner surface of said drum is in fluid communication with a delivery duct. Preferably, each compartment of said storage means is in fluid communication with a delivery duct. Preferably, a single delivery duct is associated with a single compartment of said storage means. Additionally or alternatively, a single delivery duct is preferably associated with a single first or second elongate protrusion or single lifter as defined herein.

Dimensions and Surfaces

The dimensions of said storage means, said valve and said dispensing aperture, and said optional elongate protrusion(s) are preferably such that they have no internal dimension which is less than 2 times, more preferably which is less than 3 times, more preferably which is less than 4 times, the longest dimension of the solid particulate material. Similarly, the dimensions of said first collecting aperture and said second collecting aperture are preferably at least 2 times, preferably at least 3 times, more preferably at least 4 times, the longest dimension of the solid particulate material. Such dimensions help to maintain the particle flow and the speed thereof, as well as preventing blockages.

The elements of the drum which come into contact with the substrates to be treated preferably present a smooth surface to said substrates, so that the substrates do not become trapped or snag on said elements. Such elements include the inner and end walls of the drum and the valve, dispensing aperture and optional elongate protrusions.

The Solid Particulate Material and the Method of Treatment of Substrates Therewith The drum and the apparatus of the present invention are preferably configured for the treatment of substrates with solid particulate material in the presence of a liquid medium and/or one of more treatment formulation(s).

The solid particulate material preferably comprises a multiplicity of particles. Typically, the number of particles is no less than 1000, more typically no less than 10,000, even more typically no less than 100,000. A large number of particles is particularly advantageous in preventing creasing and/or for improving the uniformity of treating or cleaning of the substrate, particularly wherein the substrate is a textile.

Preferably, the particles have an average mass of from about 1 mg to about 1000 mg, or from about 1 mg to about 700 mg, or from about 1 mg to about 500 mg, or from about 1 mg to about 300 mg, preferably at least about 10 mg, per particle. In one preferred embodiment, the particles preferably have an average mass of from about 1 mg to about 150 mg, or from about 1 mg to about 70 mg, or from about 1 mg to about 50 mg, or from about 1 mg to about 35 mg, or from about 10 mg to about 30 mg, or from about 12 mg to about 25 mg. In an alternative embodiment, the particles preferably have an average mass of from about 10 mg to about 800 mg, or from about 20 mg to about 700 mg, or from about 50 mg to about 700 mg, or from about 70 mg to about 600 mg from about 20 mg to about 600 mg. In one preferred embodiment, the particles have an average mass of about 25 to about 150 mg, preferably from about 40 to about 80 mg. In a further preferred embodiment, the particles have an average mass of from about 150 to about 500 mg, preferably from about 150 to about 300 mg.

The average volume of the particles is preferably in the range of from about 5 to about 500 $mm^3$, from about 5 to about 275 $mm^3$, from about 8 to about 140 $mm^3$, or from about 10 to about 120 $mm^3$, or at least 40 $mm^3$, for instance from about 40 to about 500 $mm^3$, or from about 40 to about 275 $mm^3$, per particle.

The average surface area of the particles is preferably from 10 $mm^2$ to 500 $mm^2$ per particle, preferably from 10 $mm^2$ to 400 $mm^2$, more preferably from 40 to 200 $mm^2$ and especially from 50 to 190 $mm^2$.

The particles preferably have an average particle size of at least 1 mm, preferably at least 2 mm, preferably at least 3 mm, preferably at least 4 mm, and preferably at least 5 mm. The particles preferably have an average particle size no more than 100 mm, preferably no more than 70 mm, preferably no more than 50 mm, preferably no more than 40 mm, preferably no more than 30 mm, preferably no more than 20 mm, preferably no more than 10 mm, and optionally no more than 7 mm. Preferably, the particles have an average particle size of from 1 to 50 mm, preferably from 1 to 20 mm, more preferably from 1 to 10 mm, more preferably from 2 to 10 mm, more preferably from 5 to 10 mm. Particles which offer an especially prolonged effectiveness over a number of treatment cycles are those with an average particle size of at least 5 mm, preferably from 5 to 10 mm. The size is preferably the largest linear dimension (length). For a sphere this equates to the diameter. For non-spheres this corresponds to the longest linear dimension. The size is preferably determined using Vernier callipers. The average particle size is preferably a number average. The determination of the average particle size is preferably performed by measuring the particle size of at least 10, more preferably at least 100 particles and especially at least 1000 particles. The above mentioned particle sizes provide especially good performance (particularly cleaning performance) whilst also permitting the particles to be readily separable from the substrate at the end of the treatment method.

The particles preferably have an average particle density of greater than 1 $g/cm^3$, more preferably greater than 1.1 $g/cm^3$, more preferably greater than 1.2 $g/cm^3$, even more preferably at least 1.25 $g/cm^3$, even more preferably greater than 1.3 $g/cm^3$, and even more preferably greater than 1.4 $g/cm^3$. The particles preferably have an average particle density of no more than 3 $g/cm^3$ and especially no more than 2.5 $g/cm^3$. Preferably, the particles have an average density of from 1.2 to 3 $g/cm^3$. These densities are advantageous for further improving the degree of mechanical action which assists in the treatment process and which can assist in permitting better separation of the particles from the substrate after the treatment.

Unless otherwise stated, reference herein to an "average" is to a mean average, preferably an arithmetic mean average, as is conventional in this art.

The particles of the solid particulate material may be polymeric and/or non-polymeric particles. Suitable non-polymeric particles may be selected from metal, alloy, ceramic and glass particles. Preferably, however, the particles of the solid particulate material are polymeric particles.

Preferably the particles comprise a thermoplastic polymer. A thermoplastic polymer, as used herein, preferably means a material which becomes soft when heated and hard when cooled. This is to be distinguished from thermosets (e.g. rubbers) which will not soften on heating. A more preferred thermoplastic is one which can be used in hot melt compounding and extrusion.

The polymer preferably has a solubility in water of no more than 1 wt %, more preferably no more than 0.1 wt % in water and most preferably the polymer is insoluble in water. Preferably the water is at pH 7 and a temperature of 20° C. whilst the solubility test is being performed. The solubility test is preferably performed over a period of 24 hours. The polymer is preferably not degradable. By the words "not degradable" it is preferably meant that the polymer is stable in water without showing any appreciable tendency to dissolve or hydrolyse. For example, the polymer shows no appreciable tendency to dissolve or hydrolyse over a period of 24 hrs in water at pH 7 and at a temperature of 20° C. Preferably a polymer shows no appreciable tendency to dissolve or hydrolyse if no more than about 1 wt %, preferably no more than about 0.1 wt % and preferably none of the polymer dissolves or hydrolyses, preferably under the conditions defined above. The solubility and degradability characteristics are preferably assessed on a polymeric particle as disclosed herein. The solubility and degradability characteristics are preferably equally applicable to non-polymeric particles.

The polymer may be crystalline or amorphous or a mixture thereof.

The polymer can be linear, branched or partly cross-linked (preferably wherein the polymer is still thermoplastic in nature), more preferably the polymer is linear.

The polymer preferably is or comprises a polyalkylene, a polyamide, a polyester or a polyurethane and copolymers and/or blends thereof, preferably from polyalkylenes, polyamides and polyesters, preferably from polyamides and polyalkylene, and preferably from polyamides.

A preferred polyalkylene is polypropylene.

A preferred polyamide is or comprises an aliphatic or aromatic polyamide, more preferably an aliphatic polyamide. Preferred polyamides are those comprising aliphatic chains, especially $C_4$-$C_{16}$, $C_4$-$C_{12}$ and $C_4$-$C_{10}$ aliphatic chains. Preferred polyamides are or comprise Nylons. Preferred Nylons include Nylon 4,6, Nylon 4,10, Nylon 5, Nylon 5,10, Nylon 6, Nylon 6,6, Nylon 6/6,6, Nylon 6,6/6, 10, Nylon 6,10, Nylon 6,12, Nylon 7, Nylon 9, Nylon 10, Nylon 10,10, Nylon 11, Nylon 12, Nylon 12,12 and copolymers or blends thereof. Of these, Nylon 6, Nylon 6,6 and Nylon 6,10, and particularly Nylon 6 and Nylon 6,6, and copolymers or blends thereof are preferred. It will be appreciated that these Nylon grades of polyamides are not degradable, wherein the word degradable is preferably as defined above.

Suitable polyesters may be aliphatic or aromatic, and preferably derived from an aromatic dicarboxylic acid and a $C_1$-$C_6$, preferably $C_2$-$C_4$ aliphatic diol. Preferably, the aromatic dicarboxylic acid is selected from terephthalic acid, isophthalic acid, phthalic acid, 1,4-, 2,5-, 2,6- and 2,7-naphthalenedicarboxylic acid, and is preferably terephthalic acid or 2,6-naphthalenedicarboxylic acid, and is most preferably terephthalic acid. The aliphatic diol is preferably ethylene glycol or 1,4-butanediol. Preferred polyesters are selected from polyethylene terephthalate and polybutylene terephthalate. Useful polyesters can have a molecular weight corresponding to an intrinsic viscosity measurement in the range of from about 0.3 to about 1.5 dl/g, as measured by a solution technique such as ASTM D-4603.

Preferably, polymeric particles comprise a filler, preferably an inorganic filler, suitably an inorganic mineral filler in particulate form, such as $BaSO_4$. The filler is preferably present in the particle in an amount of at least 5 wt %, more preferably at least 10 wt %, even more preferably at least 20 wt %, yet more preferably at least 30 wt % and especially at least 40 wt % relative to the total weight of the particle. The filler is typically present in the particle in an amount of no more than 90 wt %, more preferably no more than 85 wt %, even more preferably no more than 80 wt %, yet more preferably no more than 75 wt %, especially no more than 70 wt %, more especially no more than 65 wt % and most especially no more than 60 wt % relative to the total weight of the particle. The weight percentage of filler is preferably established by ashing. Preferred ashing methods include ASTM D2584, D5630 and ISO 3451, and preferably the test method is conducted according to ASTM D5630. For any standards referred to in the present invention, unless specified otherwise, the definitive version of the standard is the most recent version which precedes the priority filing date of this patent application. Preferably, the matrix of said polymer optionally comprising filler(s) and/or other additives extends throughout the whole volume of the particles.

The particles can be spheroidal or substantially spherical, ellipsoidal, cylindrical or cuboid. Particles having shapes which are intermediate between these shapes are also possible. The best results for treatment performance (particularly cleaning performance) and separation performance (separating the substrate from the particles after the treating steps) in combination are typically observed with ellipsoidal particles. Spheroidal particles tend to separate best but may not provide optimum treatment or cleaning performance. Conversely, cylindrical or cuboid particles separate poorly but treat or clean effectively. Spheroidal and ellipsoidal particles are particularly useful where improved fabric care is important because they are less abrasive. Spheroidal or ellipsoidal particles are particularly useful in the present invention which is designed to operate without a particle pump and wherein the transfer of the particles between the storage means and the interior of the drum is facilitated by rotation of the drum.

The term "spheroidal", as used herein, encompasses spherical and substantially spherical particles. Preferably, the particles are not perfectly spherical. Preferably, the particles have an average aspect ratio of greater than 1, more preferably greater than 1.05, even more preferably greater than 1.07 and especially greater than 1.1. Preferably, the particles have an average aspect ratio of less than 5, preferably less than 3, preferably less than 2, preferably less than 1.7 and preferably less than 1.5. The average is preferably a number average. The average is preferably performed on at least 10, more preferably at least 100 particles and especially at least 1000 particles. The aspect ratio for each particle is preferably given by the ratio of the longest linear dimension divided by the shortest linear dimension. This is preferably measured using Vernier Callipers. Where a good balance between treating performance (particularly cleaning performance) and substrate care is required, it is preferred that the average aspect ratio is within the abovementioned values. When the particles have a very low aspect ratio (e.g. highly spherical particles), the particles may not provide sufficient mechanical action for good treating or cleaning characteristics. When the particles have an aspect ratio which is too high, the removal of the particles from the substrate may become more difficult and/or the abrasion on the substrate may become too high, which may lead to unwanted damage to the substrate, particularly wherein the substrate is a textile.

According to a third aspect of the present invention, there is provided a method for treating a substrate, the method comprising agitating the substrate with solid particulate material in the drum of the present invention or in the apparatus of the present invention, as described herein. It will be appreciated that the features, preferences and embodiments described herein in respect of the drum, the apparatus and solid particulate material are applicable to the third aspect of the invention.

Preferably, in the method of the present invention, the solid particulate material is re-used in further treatment procedures.

Preferably the method additionally comprises separating the solid particulate material from the treated substrate. The solid particulate material is preferably stored in the storage means for use in the next treatment procedure.

Thus, it will be appreciated that the solid particulate material preferably does not become affixed to or associated with the substrate as a result of the treatment.

Preferably the method comprises rotating the drum for multiple rotations with said valve in said open position and further comprises rotating the drum for multiple rotations with said valve in said closed position.

It will be appreciated that during the step of agitating the substrate with solid particulate material, the drum rotates for multiple rotations. Rotation in both clockwise and counter-clockwise directions (when viewed from the end of the drum furthest from the end wall) during the agitating phase may be preferable in order to facilitate circulation of the solid particulate material through the drum and storage means. The agitating phase may comprise a greater number of rotations one direction that the other.

The method preferably comprises agitating the substrate with solid particulate material and a liquid medium. Preferably, the method comprises agitating the substrate with said solid particulate material and a treatment formulation. Preferably, the method comprises agitating the substrate with said solid particulate material, a liquid medium and one or more treatment formulation(s).

The method may comprise the additional step of rinsing the treated substrate. Rinsing is preferably performed by adding a rinsing liquid medium, optionally comprising one or more post-treatment additives, to the treated substrate. The rinsing liquid medium is preferably an aqueous medium as defined herein.

Thus, preferably, the method is a method for treating multiple batches, wherein a batch comprises at least one substrate, the method comprising agitating a first batch with solid particulate material, wherein said method further comprises the steps of:

(a) collecting said solid particulate material in the storage means;

(b) agitating a second batch comprising at least one substrate with solid particulate material collected from step (a); and (c) optionally repeating steps (a) and (b) for subsequent batch(es) comprising at least one substrate.

In the method, solid particulate material can be dispensed into the interior of the drum when said valve is in the open position whereas solid particulate material is not dispensed into the interior of the drum when said valve in in the closed position. In whichever direction the drum rotates, when the valve is in the closed position, solid particulate material is prevented from passing through the dispensing aperture. In this way, when the valve is in the closed position, the drum can be rotated in a clockwise direction and in a counter-clockwise direction (when viewed from the end of the drum furthest the end wall) without any solid particulate material being released from said storage means.

When the drum comprises a collecting means, such as one or more elongate protrusions, solid particulate material can be collected, leading to a build-up of solid particulate material in the storage means during periods where the valve is in the closed position. In this way, the method allows the interior of said drum to be substantially emptied of solid particulate material. This can be particularly advantageous where the treatment of the substrate has an additional stage where the absence of solid particulate material is preferred. Furthermore, this can be advantageous for reducing the amount of solid particulate material mixed with the substrate on removal of the substrate from the drum at the end of treatment.

Preferably, the method comprises a first period during which said valve is in said open position and a second period during which said valve is in said closed position. The method may comprise a plurality of first periods and/or a plurality of second periods. For instance, once the substrates have been put into the drum, the method may comprise a first period where the solid particulate material is dispensed into the interior of the drum and the treatment of the substrate commences. During the first period, solid particulate material may be collected via the collecting means and then dispensed again from the storage means via the dispensing aperture. In this way there may be a cycling of solid particulate material between the storage means and the interior of the drum. The method may then comprise a second period where solid particulate material is collected via the collecting means but is no longer dispensed via the dispensing aperture.

Typically, the duration of said first period is substantially equal to or exceeds the duration of said second period.

Preferably, said first period precedes said second period.

The method may comprise bringing the drum to a standstill for a dwelling period before closing the valve. The dwelling period may be between about 0.5 and about 60 seconds, or between about 1 and about 30 seconds, or between about 1 and about 10 seconds. This may allow residual particles to clear the valve before it is closed.

Alternatively, the method may comprise rotating the drum at a speed to induce a force at the periphery of the valve (or where the valve is not substantially circular, at a point on the circular path travelled by the part of the valve furthest from the centre of rotation of the drum during rotation of the drum) of greater than or equal to about 1 G and closing the valve during rotation of the drum at that speed. The speed of rotation whilst the valve is closed may induce a force no greater than about 200 G or no greater than about 100 G, or no greater than about 10 G, or no greater than about 5 G, or no greater than about 2 G. The duration of rotation may be between about 1 second and about 5 minutes, or may be between about 1 second and about 20 seconds, or may be between about 1 second and about 10 seconds. This rotating the drum in this manner may cause any residual particles in the storage means to be displaced radially outwards and therefore be clear of the valve whilst it is closed.

The treatment procedure of an individual batch typically comprises the steps of agitating the batch with said solid particulate material in a treatment apparatus for a treatment cycle. A treatment cycle typically comprises one or more discrete treatment step(s), optionally one or more rinsing step(s), optionally one or more step(s) of separating the solid particulate material from the treated batch (a "separation step"), optionally one or more extraction step(s) of removing liquid medium from the treated batch, optionally one or more drying step(s), and optionally the step of removing the treated batch from the apparatus.

In the method of the present invention, steps (a) and (b) may be repeated at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times. Thus, the same solid particulate material is preferably re-used in repeated methods of the present invention, i.e. the solid particulate material is re-used preferably at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times.

The substrate may be or comprise a textile and/or an animal skin substrate. In a preferred embodiment, the substrate is or comprises a textile. The textile may be in the form of an item of clothing such as a coat, jacket, trousers, shirt, skirt, dress, jumper, underwear, hat, scarf, overalls, shorts, swim wear, socks and suits. The textile may also be in the form of a bag, belt, curtains, rug, blanket, sheet or a furniture covering. The textile can also be in the form of a panel, sheet or roll of material which is later used to prepare the finished item or items. The textile can be or comprise a synthetic fibre, a natural fibre or a combination thereof. The textile can comprise a natural fibre which has undergone one or more chemical modifications. Examples of natural fibres include hair (e.g. wool), silk and cotton. Examples of synthetic textile fibres include Nylon (e.g. Nylon 6,6), acrylic, polyester and blends thereof. As used herein, the term "animal skin substrate" includes, hides, pelts, leather and fleeces. Typically, the animal skin substrate is a hide or a pelt. The hide or pelt may be a processed or unprocessed animal skin substrate. Suitable animal skin substrates include cattle, pigs, sheep, goats and buffalo. Preferably the animal skin substrate is a bovine skin substrate. Skin substrates of livestock and especially cattle are preferred. It will be appreciated that, in the context of the present invention, the term "animal skin" excludes human skin.

The treating of a substrate which is or comprises a textile according to the present invention may be a cleaning process or any other treatment process such as coloration (preferably dyeing), ageing or abrading (for instance stone-washing), bleaching or other finishing process. Stonewashing is a known method for providing textiles having "worn in" or "stonewashed" characteristics such as a faded appearance, a softer feel and a greater degree of flexibility. Stonewashing is frequently practiced with denim. Preferably the treating of a substrate which is or comprises a textile is a cleaning process. The cleaning process may be a domestic or industrial cleaning process.

As used herein, the term "treating" in relation to treating an animal skin substrate is preferably a tannery process, including colouring and tanning and associated tannery processes, preferably selected from curing, beamhouse treatments, pre-tanning, tanning, re-tanning, fat liquoring, enzyme treatment, tawing, crusting, dyeing and dye fixing, preferably wherein said beamhouse treatments are selected from soaking, liming, deliming, reliming, unhairing, fleshing, bating, degreasing, scudding, pickling and depickling. Preferably, said treating of an animal skin substrate is a process used in the production of leather. Preferably, said treating acts to transfer a tanning agent (including a colourant or other agent used in a tannery process) onto or into the animal skin substrate.

The treatment formulation referred to herein may comprise one or more treatment agent(s) which are suitable to effect the desired treating of the substrate.

Thus, a method according to the present invention which is a cleaning process suitably comprises agitating the substrate with said solid particulate material, a liquid medium and one or more treatment formulation(s) wherein said treatment formulation is preferably a detergent composition comprising one or more of the following components: surfactants, dye transfer inhibitors, builders, enzymes, metal chelating agents, biocides, solvents, stabilizers, acids, bases and buffers.

Similarly, the treatment formulation of a coloration process is preferably a composition comprising one or more dyes, pigments, optical brighteners and mixtures thereof.

The treatment formulation of a stone-washing process may comprise an appropriate stone-washing agent, as known in the art, for instance an enzymatic treatment agent such as a cellulase.

The treatment formulation of a tannery process suitably comprises one or more agent(s) selected from tanning agents, re-tanning agents and tannery process agents. The treatment formulation may comprise one or more colourant(s). The tanning or re-tanning agent is preferably selected from synthetic tanning agents, vegetable tanning or vegetable re-tanning agents and mineral tanning agents such as chromium (III) salts or salts and complexes containing iron, zirconium, aluminium and titanium. Suitable synthetic tanning agents include amino resins, polyacrylates, fluoro and/or silicone polymers and formaldehyde condensation polymers based on phenol, urea, melamine, naphthalene, sulphone, cresol, bisphenol A, naphthol and/or biphenyl ether. Vegetable tanning agents comprise tannins which are typically polyphenols. Vegetable tanning agents can be obtained from plant leaves, roots and especially tree barks. Examples of vegetable tanning agents include the extracts of the tree barks from chestnut, oak, redoul, tanoak, hemlock, quebracho, mangrove, wattle acacia; and myrobalan. Suitable mineral tanning agents comprise chromium compounds, especially chromium salts and complexes, typically in a chromium (III) oxidation state, such as chromium (III) sulphate. Other tanning agents include aldehydes (glyoxal, glutaraldehyde and formaldehyde), phosphonium salts, metal compounds other than chromium (e.g. iron, titanium, zirconium and aluminium compounds). Preferably, the tanning agents are substantially free from chromium-containing compounds.

One or more substrates can be simultaneously treated by the method of the invention. The exact number of substrates will depend on the size of the substrates and the capacity of the apparatus utilized.

The total weight of dry substrates treated at the same time (i.e. in a single batch or washload) may be up to 50,000 kg.

For textile substrates, the total weight is typically from 1 to 500 kg, more typically 1 to 300 kg, more typically 1 to 200 kg, more typically from 1 to 100 kg, even more typically from 2 to 50 kg and especially from 2 to 30 kg. For animal substrates, the total weight is normally at least about 50 kg, and can be up to about 50,000 kg, typically from about 500 to about 30,000 kg, from about 1000 kg to about 25,000 kg, from about 2000 to about 20,000 kg, or from about 2500 to about 10,000 kg.

Preferably the liquid medium is an aqueous medium, i.e. the liquid medium is or comprises water. In order of increasing preference, the liquid medium comprises at least 50 wt %, at least 60 wt %, at least 70 wt %, at least 80 wt %, at least 90 wt %, at least 95 wt % and at least 98 wt % of water. The liquid medium may optionally comprise one or more organic liquids including for example alcohols, glycols, glycol ethers, amides and esters. Preferably, the sum total of all organic liquids present in the liquid medium is no more than 10 wt %, more preferably no more than 5 wt %, even more preferably no more than 2 wt %, especially no more than 1% and most especially the liquid medium is substantially free from organic liquids.

The liquid medium preferably has a pH of from 3 to 13. The pH or the treatment liquor can differ at different times, points or stages in the treatment method according to the invention. It can be desirable to treat (particularly to clean) a substrate under alkaline pH conditions, although while higher pH offers improved performance (particularly cleaning performance) it can be less kind to some substrates. Thus, it can be desirable that the liquid medium has a pH of from 7 to 13, more preferably from 7 to 12, even more preferably from 8 to 12 and especially from 9 to 12. In a further preferred embodiment, the pH is from 4 to 12, preferably 5 to 10, especially 6 to 9, and most especially 7 to 9, particularly in order to improve fabric care. It may also be desirable that the treating of a substrate, or one or more specific stage(s) of a treatment process, is conducted under acid pH conditions. For instance, certain steps in the treatment of animal skin substrates are advantageously conducted at a pH which is typically less than 6.5, even more typically less than 6 and most typically less than 5.5, and typically no less than 1, more typically no less than 2 and most typically no less than 3. Certain fabric or garment finishing treatment methods, for instance stone-washing, may also utilise one or more acidic stage(s). An acid and/or base may be added in order to obtain the abovementioned pH values. Preferably, the abovementioned pH is maintained for at least a part of the duration, and in some preferred embodiments for all of the duration, of the agitation. In order to prevent the pH of the liquid medium from drifting during the treatment, a buffer may be used.

Preferably, the weight ratio of the liquid medium to the dry substrate is no more than 20:1, more preferably no more than 10:1, especially no more than 5:1, more especially no more than 4.5:1 and even more especially no more than 4:1 and most especially no more than 3:1. Preferably, the weight ratio of liquid medium to the dry substrate is at least 0.1:1, more preferably at least 0.5:1 and especially at least 1:1. In the present invention, it is possible to use surprisingly small amounts of liquid medium whilst still achieving good treatment performance (particularly cleaning performance), which has environmental benefits in terms of water usage, waste water treatment and the energy required to heat or cool the water to the desired temperature.

Preferably, the ratio of particles to dry substrate is at least 0.1, especially at least 0.5 and more especially at least 1:1 w/w. Preferably, the ratio of particles to dry substrate is no more than 30:1, more preferably no more than 20:1, especially no more than 15:1 and more especially no more than 10:1 w/w. Preferably, the ratio of the particles to dry substrate is from 0.1:1 to 30:1, more preferably from 0.5:1 to 20:1, especially from 1:1 to 15:1 w/w and more especially from 1:1 to 10:1 w/w.

The treatment method agitates the substrate in the presence of the solid particulate material. The agitation may be in the form of shaking, stirring, jetting and tumbling. Of these, tumbling is especially preferred. Preferably, the substrate and solid particulate material are introduced into the drum which is rotated so as to cause tumbling. The rotation can be such as to provide a centripetal force of from 0.05 to 1 G and especially from 0.05 to 0.7 G. The centripetal force is preferably as calculated at the interior walls of the drum furthest away from the axis of rotation.

The solid particulate material is able to contact the substrate, suitably mixing with the substrate during the agitation.

The agitation may be continuous or intermittent. Preferably, the method is performed for a period of from 1 minute to 10 hours, more preferably from 5 minutes to 3 hours and even more preferably from 10 minutes to 2 hours.

The treatment method is preferably performed at a temperature of from greater than 0° C. to about 95° C., preferably from 5 to 95° C., preferably at least 10° C., preferably at least 15° C., preferably no more than 90° C., preferably no more than 70° C., and advantageously no more 50° C., no more than 40° C. or no more than 30° C. Such milder temperatures allow the particles to provide the afore-mentioned benefits over larger numbers of treatment cycles. Preferably, when several batches or washloads are treated or cleaned, every treating or cleaning cycle is performed at no more than a temperature of 95° C., more preferably at no more than 90° C., even more preferably at no more than 80° C., especially at no more than 70° C., more especially at no more than 60° C. and most especially at no more than 50° C., and from greater than 0° C., preferably at least 5° C., preferably at least 10° C., preferably at least 15° C., preferably from greater than 0 to 50° C., greater than 0 to 40° C., or greater than 0 to 30° C., and advantageously from 15 to 50° C., 15 to 40° C. or 15 to 30° C. These lower temperatures again allow the particles to provide the benefits for a larger number of treatment or wash cycles.

It will be appreciated that the duration and temperature conditions described hereinabove are associated with the treating of an individual batch comprising at least one of said substrate(s).

Agitation of the substrates with the solid particulate material suitably takes place in said one or more discrete treating step(s) of the aforementioned treatment cycle. Thus, the duration and temperature conditions described hereinabove are preferably associated with the step of agitating said substrate(s) with solid particulate material, i.e. said one or more discrete treating step(s) of the aforementioned treatment cycle.

Preferably, the method is a method for cleaning a substrate, preferably a laundry cleaning method, preferably a method for cleaning a substrate which is or comprises a textile. Thus, preferably, a batch is a washload. Preferably the washload comprises at least one soiled substrate, preferably wherein the soiled substrate is or comprises a soiled textile. The soil may be in the form of, for example, dust, dirt, foodstuffs, beverages, animal products such as sweat, blood, urine, faeces, plant materials such as grass, and inks and paints. The cleaning procedure of an individual washload typically comprises the steps of agitating the washload with said solid particulate material in a cleaning apparatus for a cleaning cycle. A cleaning cycle typically comprises one or more discrete cleaning step(s) and optionally one or more post-cleaning treatment step(s), optionally one or more rinsing step(s), optionally one or more step(s) of separating the cleaning particles from the cleaned washload, optionally one or more extraction step(s) of removing liquid medium from the cleaned washload, optionally one or more drying step(s), and optionally the step of removing the cleaned washload from the cleaning apparatus.

Where the method is a cleaning method, the substrate is preferably agitated with said solid particulate material, a liquid medium, and preferably also a detergent composition. The detergent composition may comprise any one or more of the following components: surfactants, dye transfer inhibitors, builders, enzymes, metal chelating agents, biocides, solvents, stabilizers, acids, bases and buffers. In particular, the detergent composition may comprise one or more enzyme(s).

Where the method is a cleaning method, optional post-cleaning additives which may be present in a rinsing liquid medium include optical brightening agents, fragrances and fabric softeners.

Kit for Conversion of Conventional Apparatus and Method of Retrofitting

According to a fourth aspect of the present invention, there is provided a kit for converting an apparatus which is not suitable for use in the treatment of substrates using a solid particulate material into an apparatus according to the present invention and defined hereinabove which is suitable for use in the treatment of substrates using a solid particulate material, wherein the apparatus comprises a housing having mounted therein a rotatably mounted drum having an inner surface and an end wall and which further comprises access means for introducing said substrates into said drum, and wherein said kit comprises:

(a) solid particulate material;

(b) storage means for storage of said solid particulate material, wherein at least part of said storage means is or comprises at least one cavity located in said end wall of said drum;

(c) a dispensing aperture for dispensing solid particulate material from said storage means in to the interior of said drum, wherein said dispensing aperture is comprised in said end wall of said drum; and (d) a valve that is actuatable between a closed position and an open position, wherein when said valve is in said closed position said solid particulate material is prevented from passing through said dispensing aperture and when said valve is in said open position said solid particulate material is permitted to pass through said dispensing aperture; and (e) optionally, at least one elongate protrusion as described herein wherein said kit is adapted to allow affixing of said storage means, said dispensing aperture, said valve and, where present, said elongate protrusion(s) to one or more interior surface(s) of the drum.

According to a fifth aspect of the present invention, there is provided a method of constructing an apparatus according to the present invention and as defined hereinabove which is suitable for use in the treatment of substrates using a solid particulate material, the method comprising retrofitting a starting apparatus which is not suitable for use in the treatment of substrates using a solid particulate material and which comprises a housing having mounted therein a rotatably mounted drum having an inner surface and an end wall and which further comprises access means for introducing said substrates into said drum, wherein said retrofitting comprises the steps of:

(i) providing solid particulate material, providing one or more storage means for storage of solid particulate material, and providing one or more valves and, optionally, providing at least one elongate protrusion;

(ii) affixing said storage means to one or more interior surface(s) of the drum, wherein at least part of said storage means is or comprises at least one cavity located in said end wall of said drum;

(iii) providing a dispensing aperture for dispensing solid particulate material from said storage means into the interior of said drum in said end wall of said drum;

(iv) affixing said valve to said end wall of said drum; and (v) optionally affixing to an interior surface of the drum said at least one elongate protrusion, wherein said valve is actuatable between a closed position and an open position, wherein when said valve is in said closed position said solid particulate material is prevented from passing through said dispensing aperture and when said valve is in said open position said solid particulate material is permitted to pass through said dispensing aperture.

It will be appreciated that the features, preferences and embodiments described hereinabove for the first to third aspects are applicable also to the fourth and fifth aspects.

FIGURES

The invention is further illustrated with reference to the following figures.

FIG. 1*a* schematically illustrates an end wall (2) of a cylindrical drum comprising storage means therein, the storage means comprising four compartments (4*a*, 4*b*, 4*c* and 4*d*) arranged around the rotational axis of the drum. Each compartment (4*a*, 4*b*, 4*c* and 4*d*) is defined by a cavity bound by radial walls (7) that extend outwards from the rotational axis of the drum. The end wall (2) of the drum comprises a valve (6), centrally positioned and aligned with the rotational axis of the drum. The valve covers a dispensing aperture (not shown) and is in a closed position such that solid particulate material in the storage means is prevented from passing through the dispensing aperture. The dispensing aperture is in fluid communication with each of the four compartments (4*a*, 4*b*, 4*c* and 4*d*) of the storage means.

FIG. 1*b* illustrates a section of the drum (10) of FIG. 1*a*. The end wall (2) of the drum comprises storage means (4) comprising four compartments as shown in FIG. 1*a*. The end wall (2) of the drum also comprises a dispensing aperture (12), centrally positioned in an interior surface (5) of the end wall (2) and aligned with the rotational axis of the drum. A valve (6) comprises a shank (14) and a disk (16). The valve (6) is shown in a closed position such that the disk (16) seals the dispensing aperture (12) and prevents any solid particulate material (not shown) in any of the four compartments of the storage means (4) from passing through and into the interior (22) of the drum. A seal (20) surrounds the shank (14) of the valve (6). The shank (14) of the valve sits within the drive shaft (80) of the drum. A deflector (18) is comprised within the storage means (4) and is shaped to bias solid particulate material from any of the four compartments of the storage means (4) towards the dispensing aperture (12).

FIG. 1*c* shows the valve (6) of the drum (10) of FIG. 1*b* in the open position, where the disk (16) of valve (6) projects into the interior (22) of the drum (10). As the drum (10)

rotates, solid particulate material in the compartments of the storage means (4) is urged to rotate with the drum by the radial walls (7) shown in FIG. 1*a* and is raised above the rotational axis of the drum, from where it falls under gravity and is biased by the deflector (18) towards the dispensing aperture (12), as shown by arrow A.

FIGS. 2*a* and 2*b* illustrate a cylindrical drum (10), the end wall (2) comprising storage means (4) therein, the storage means comprising four compartments (4*a*, 4*b*, 4*c* and 4*d*). The end wall (2) of the drum comprises a valve (6), centrally positioned and aligned with the rotational axis of the drum. The valve covers a dispensing aperture (12) positioned in an interior surface (5) of the end wall (2) of the drum and is in a closed position such that solid particulate material in the storage means (4) is prevented from passing through the dispensing aperture (12). A guard (30) is positioned over the valve (6) and is arranged to protect substrates (not shown) in the interior (22) of the drum (10) from being damaged by being trapped or snagged by the valve (6) and/or dispensing aperture (12). The drum comprises an alternative baffle (28), which also functions to bias solid particulate material in the storage means (4) towards the dispensing aperture (12).

FIGS. 3 and 4 show an expanded partial section of a drum (10). The end wall (2) of the drum comprises storage means (4). The end wall (2) of the drum comprises a valve (6) centrally positioned and aligned with the rotational axis of the drum. The valve comprises a disk portion (26). The end wall (2) of the drum also comprises a dispensing aperture (12). The valve (6) is actuated by a lead screw (24) which sits within and is co-axial with a drive shaft (80) of the drum. A deflector (18) is comprised within the storage means (4) and is shaped to bias solid particulate material (not shown) from the storage means (4) towards the dispensing aperture (12). A guard (30) is positioned over the valve (6) and is arranged to protect substrates (not shown) in the interior (22) of the drum from being damaged by being trapped or snagged by the valve (6) and/or dispensing aperture (12).

In FIG. 3, the valve (6) is shown in a closed position such that the disk portion (26) covers the dispensing aperture (12) and prevents solid particulate material (not shown) in the storage means (4) from passing through the dispensing aperture (12). In FIG. 4, the valve (6) is shown in an open position, whereby the lead screw (24) has actuated the valve (6) and the disk portion (26) projects into the interior (22) of the drum (10), permitting solid particulate material (not shown) in the storage means (4) to pass through the dispensing aperture (12).

FIGS. 5 and 6 show an expanded portion of a drum (10) The end wall (2) of the drum comprises storage means (4) in four sections, three of which are shown (4*a*, 4*b*, 4*c*). The end wall (2) of the drum comprises a valve (6) centrally positioned and aligned with the rotational axis of the drum. The valve comprises a disk portion (26). The end wall (2) of the drum also comprises a dispensing aperture (12). The valve (6) is actuated by a lead screw (24) which sits within and is co-axial with a drive shaft (80) of the drum. A deflector (18) is comprised within the storage means (4) and is shaped to bias solid particulate material from the storage means (4) towards the dispensing aperture (12). A guard (30) is positioned over the valve (6) and is arranged to protect substrates (not shown) in the interior (22) of the drum from being damaged by being trapped or snagged by the valve (6) and/or dispensing aperture (12).

In FIG. 5, the valve (6) is shown in an open position, whereby the lead screw (24) has actuated the valve (6) and the disk portion (26) projects into the interior (22) of the drum (10), permitting solid particulate material (not shown) in the storage means (4) to pass through the dispensing aperture (12). In FIG. 6, the valve (6) is shown in a closed position such that the disk portion (26) covers the dispensing aperture (12) and prevents solid particulate material (not shown) in the storage means (4) from passing through the dispensing aperture (12).

FIG. 7 shows the end wall (2) of a drum (10) comprising storage means therein and a valve (6), shown in the closed position such that it prevents solid particulate material in the storage means from passing through the dispensing aperture (not shown). A guard (30) is positioned over the valve (6) and is arranged to protect substrates (not shown) in the interior (22) of the drum (10) from being trapped or snagged by the valve (6) and/or dispensing aperture. Elongate protrusions (3*a*, 3*b* and 3*c*) are disposed on the cylindrical inner surface (15) of the drum (10). The elongate protrusions (3*a*, 3*b* and 3*c*) are able to collect solid particulate material from the interior (22) of the drum (10) via first collecting apertures (40) when the drum rotates in a clockwise direction when viewed from the end of the drum furthest from the end wall (2). Solid particulate material that enters the first collecting apertures (40) follows a first collecting flow path (not shown) within the elongate protrusions (3*a*, 3*b* and 3*c*) towards the storage means in the end wall (2). The elongate protrusions (3*a*, 3*b* and 3*c*) are able to collect solid particulate material from the interior (22) of the drum (10) via second collecting apertures (50) when the drum rotates in a counter-clockwise direction when viewed from the end of the drum furthest from the end wall (2). Solid particulate material that enters the second collecting apertures (50) follows a second collecting flow path (not shown) within the elongate protrusions (3*a*, 3*b* and 3*c*) towards the storage means in the end wall (2).

Figure 1A:
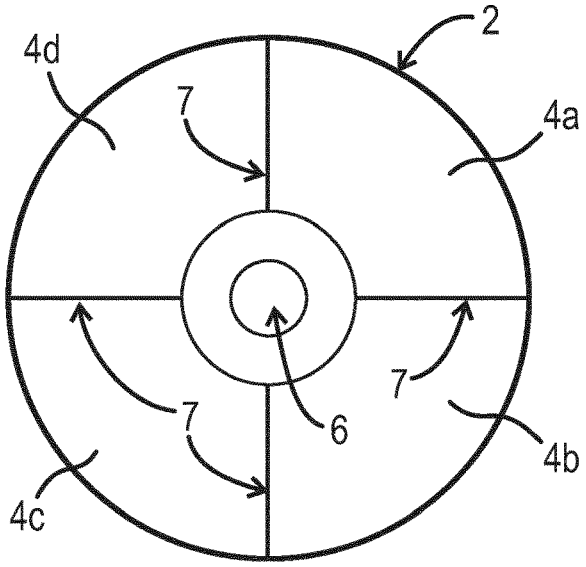
Figure 1B:
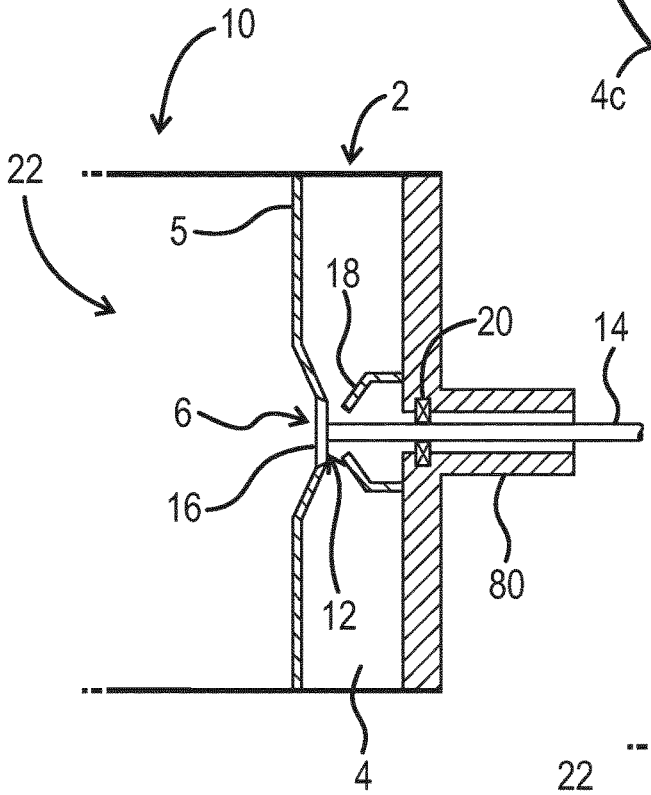
Figure 1C:
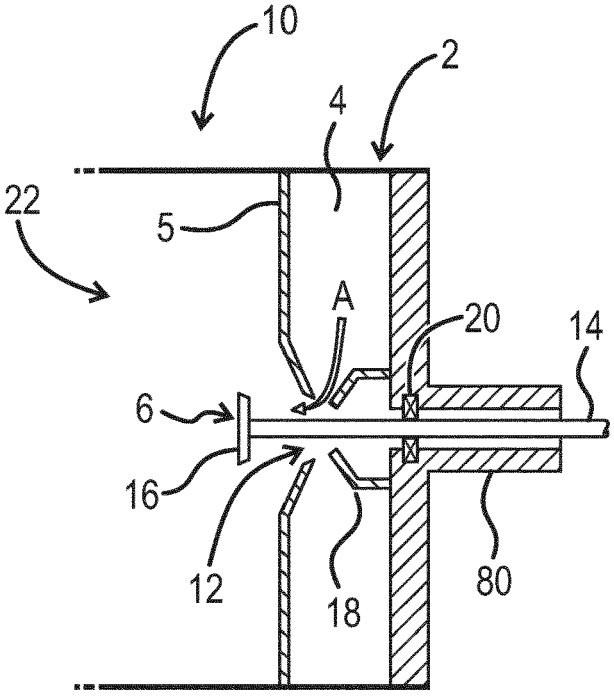
Figure 2A:
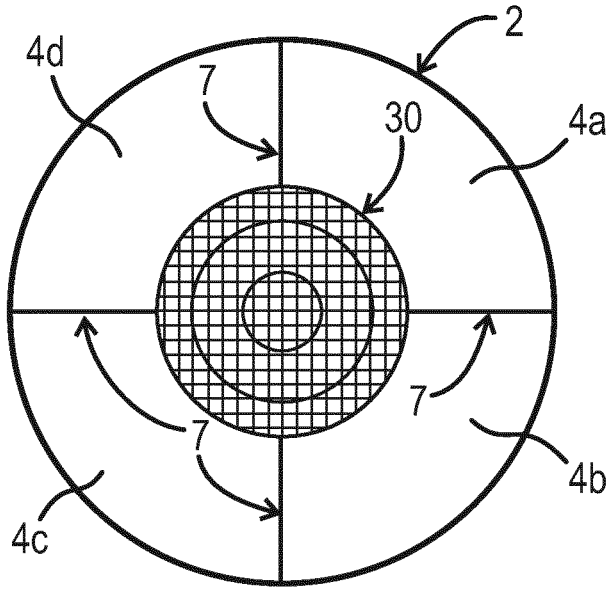
Figure 2B:
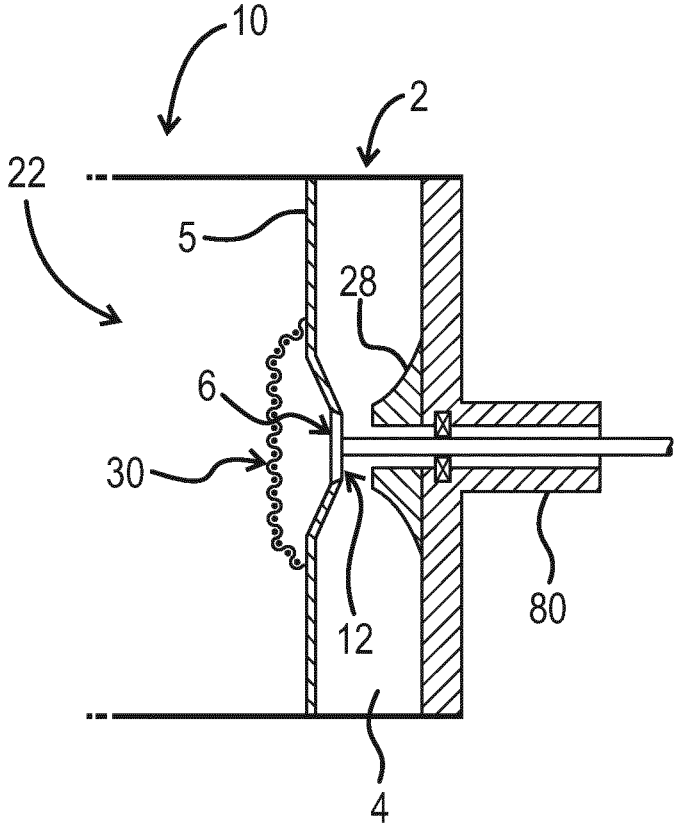
Figure 3:
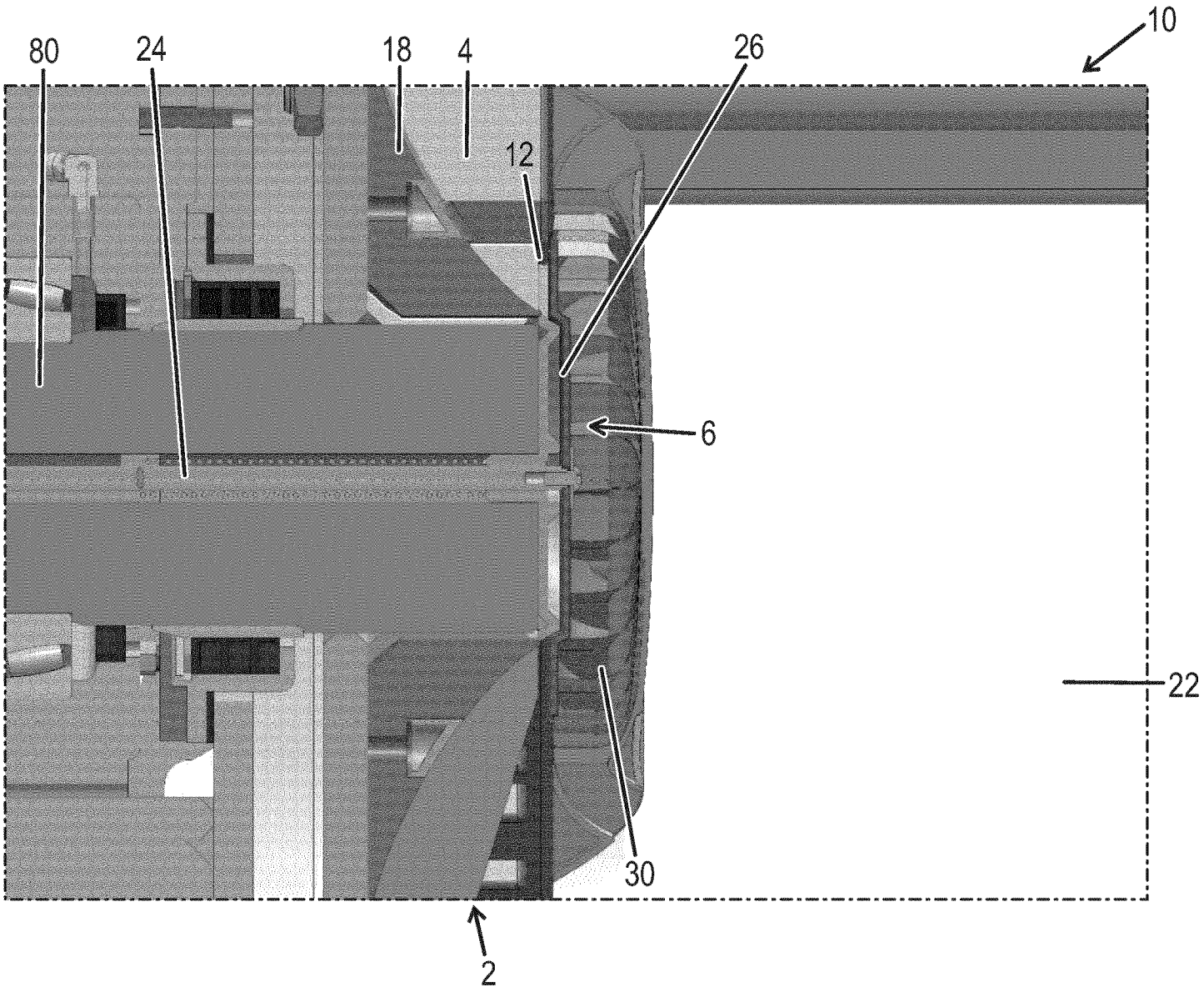
Figure 4:
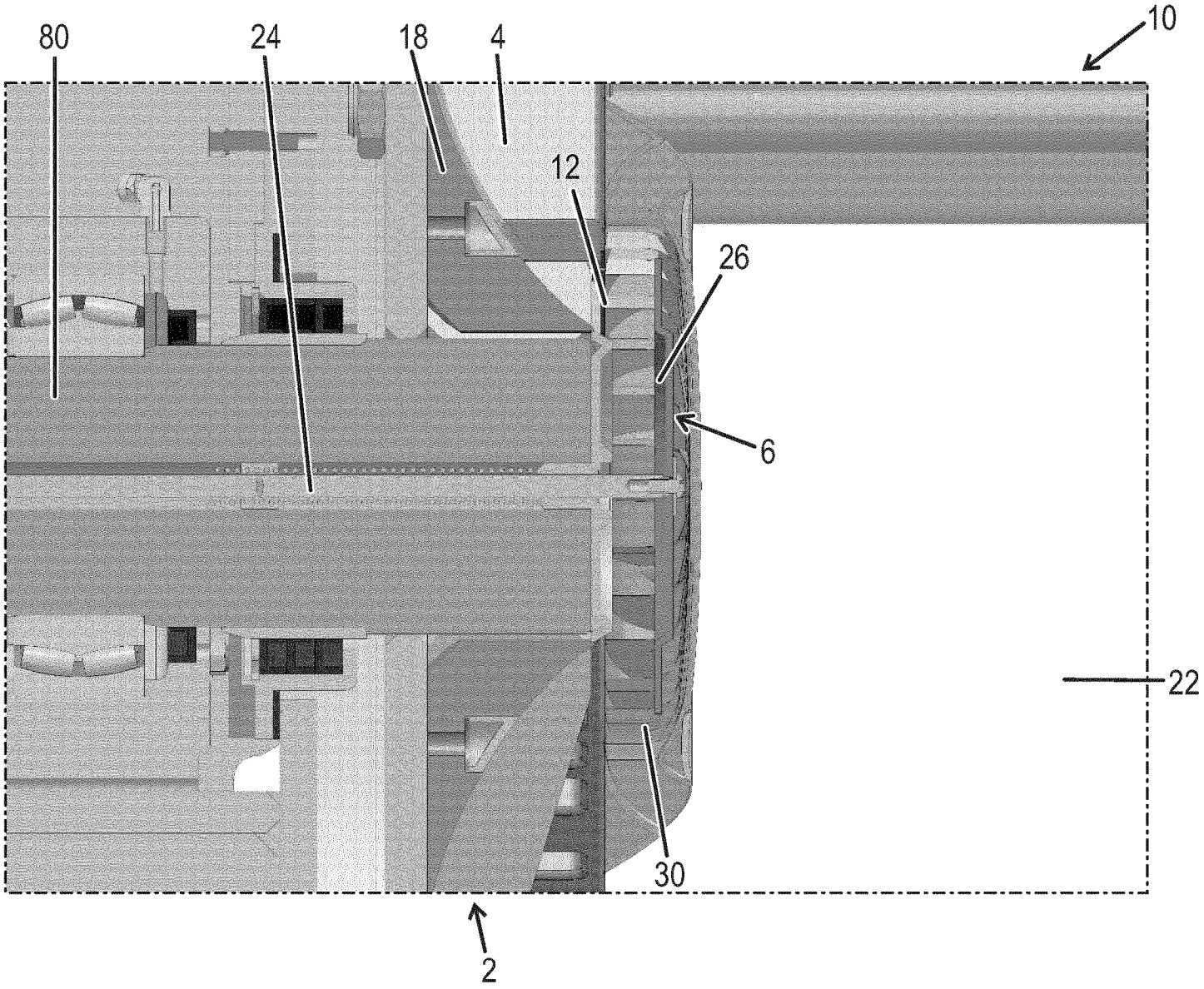
Figure 5:
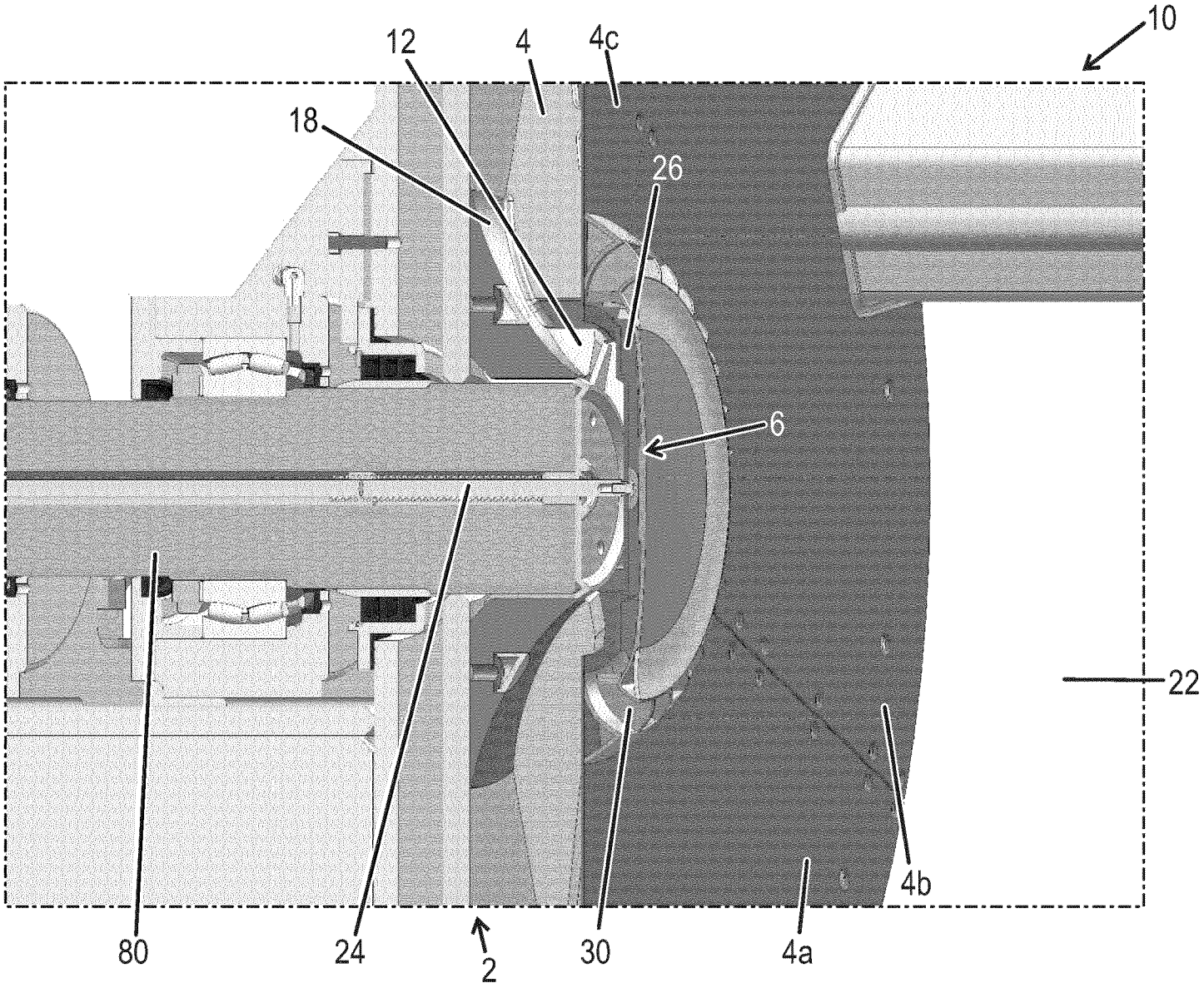
Figure 6:
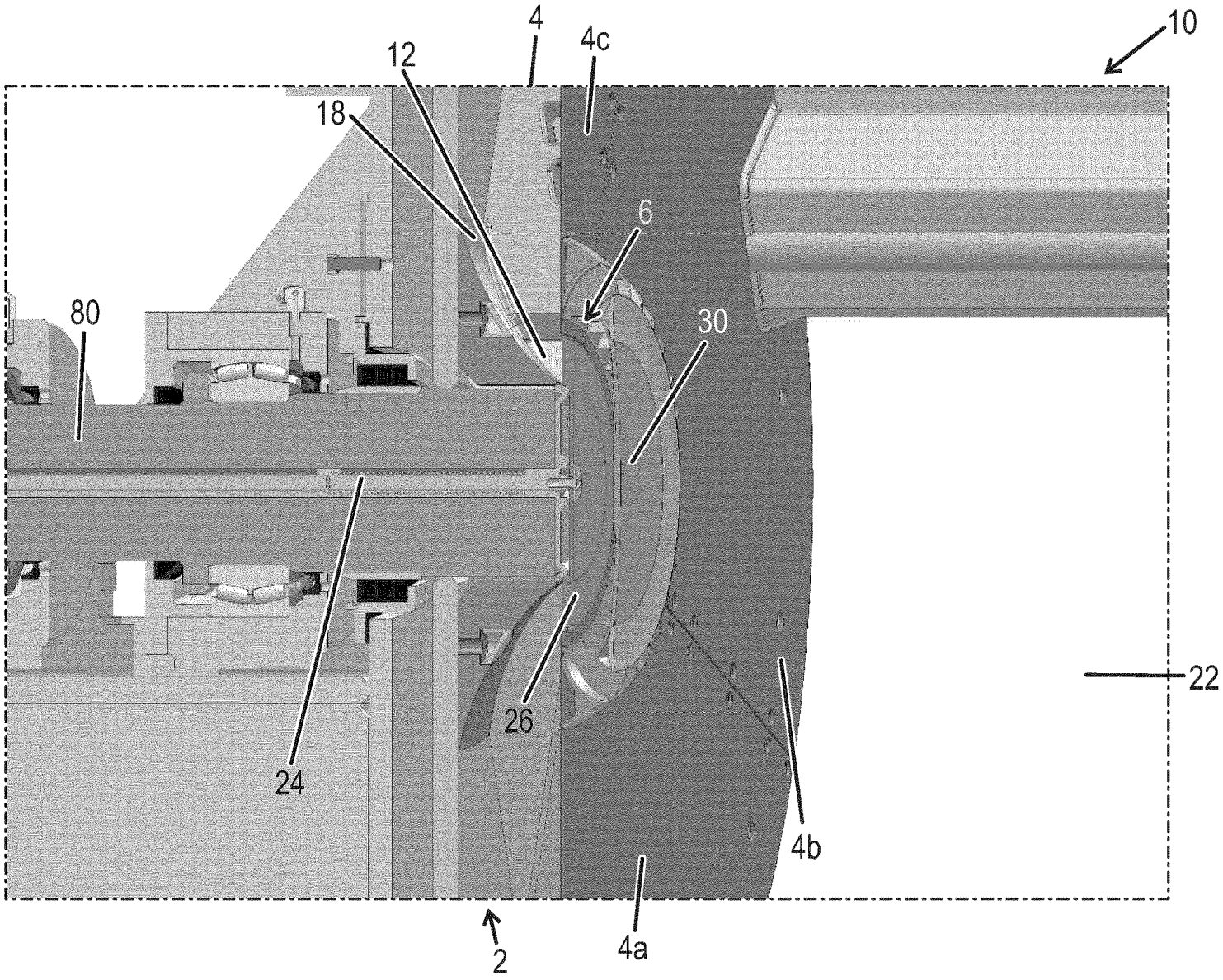
Figure 7:
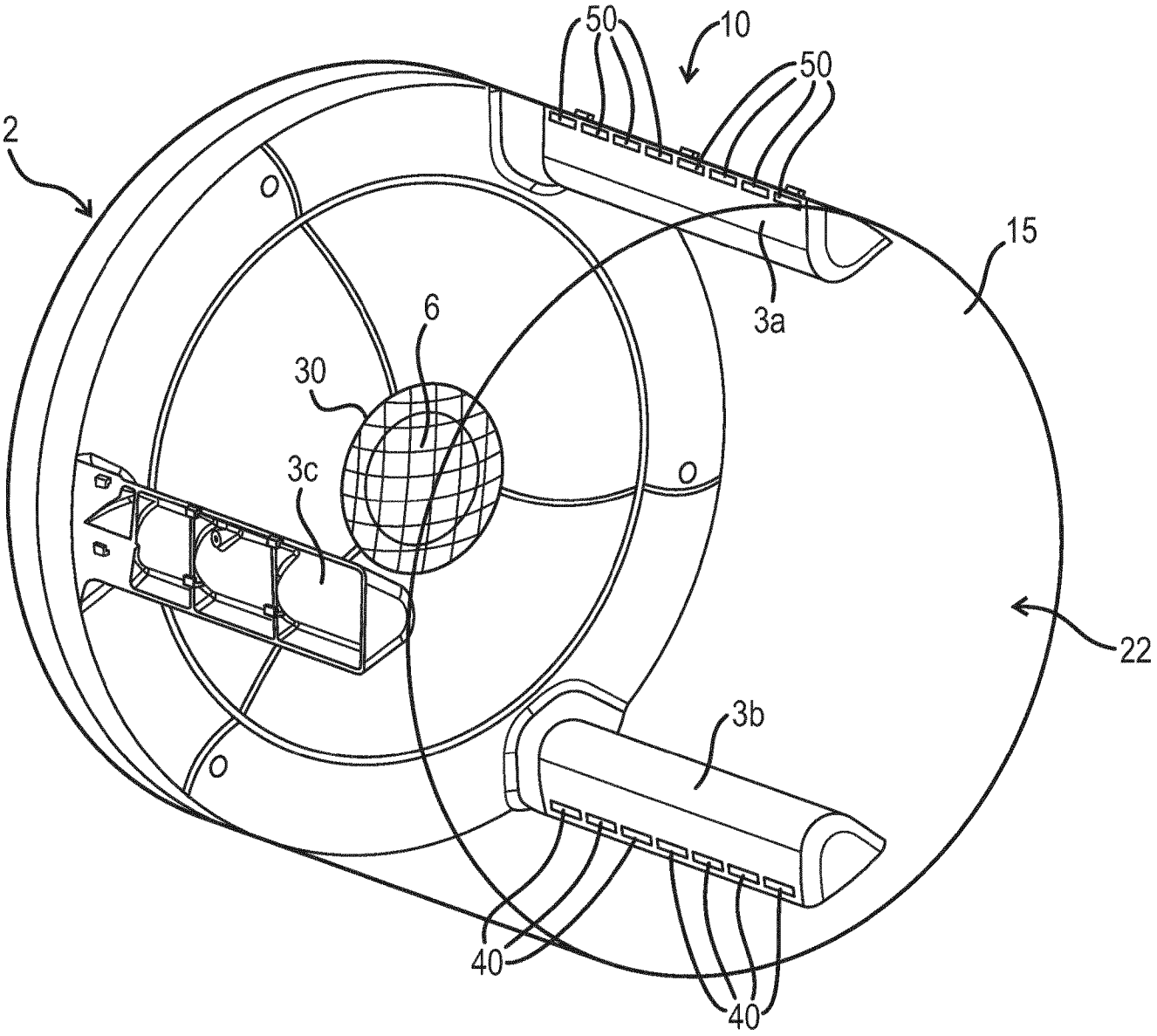
Figure 9:
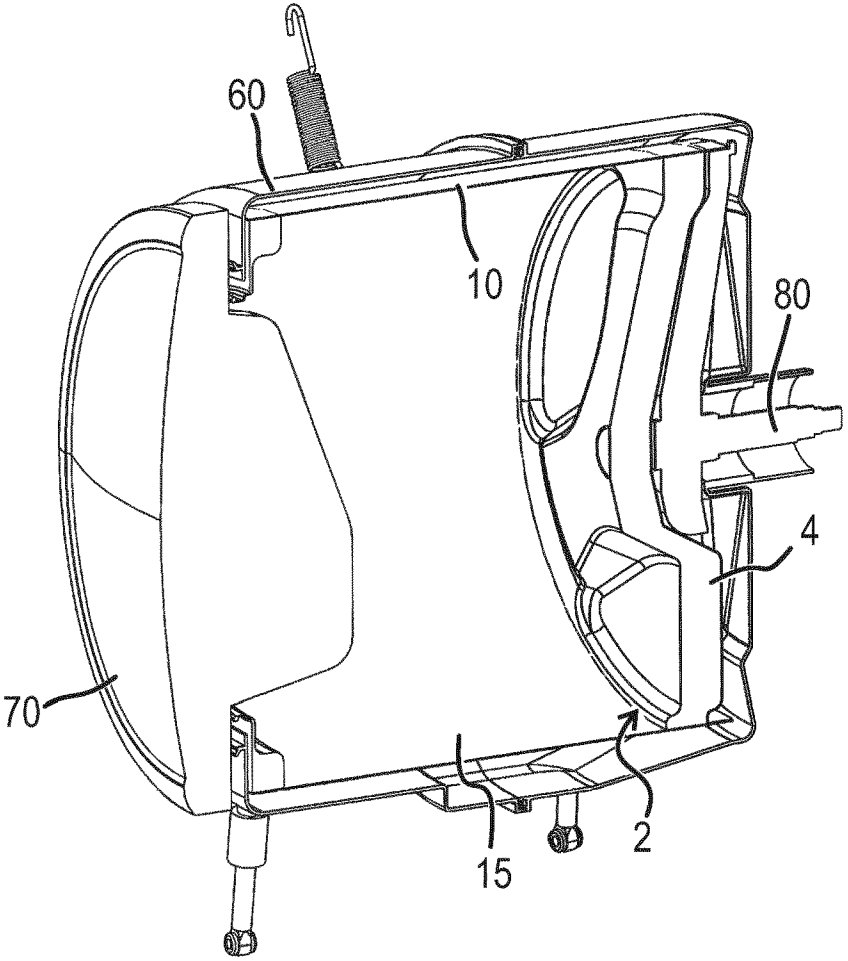
FIG. 9 shows the arrangement of FIG. 8 wherein an end wall (2) of the drum comprises a storage means (4) that had been disposed in, or retrofitted onto, an existing end wall of the drum.
Figure 8:
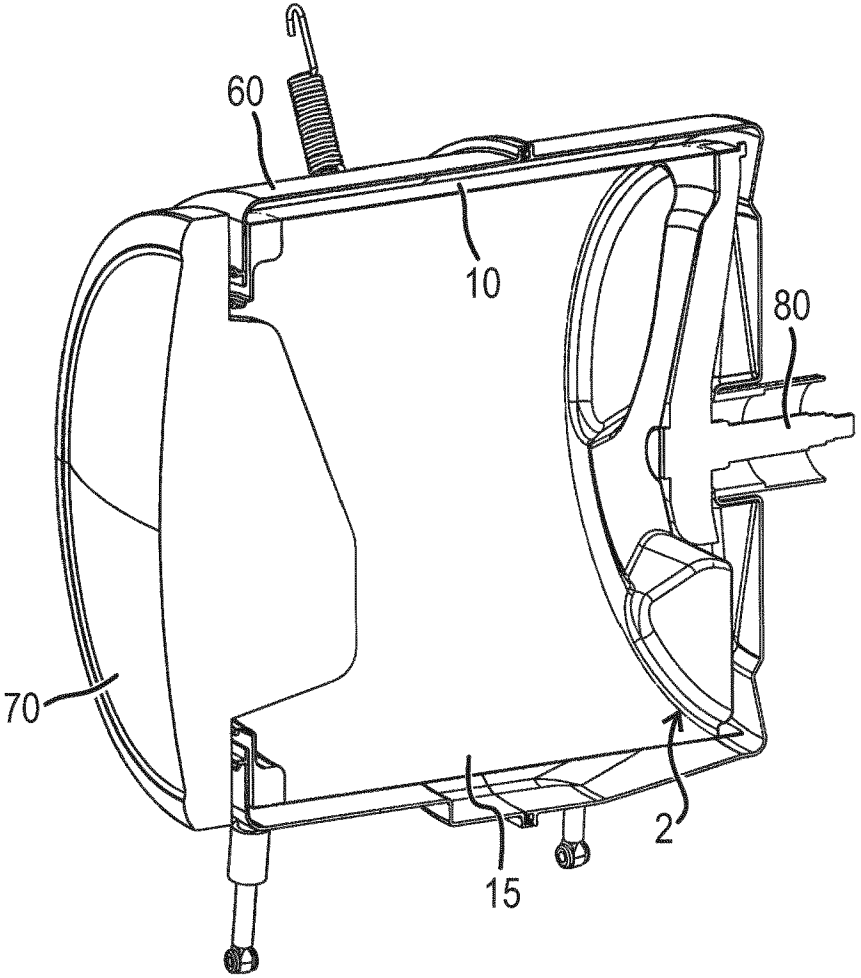
FIG. 8 shows certain elements of a rotatable drum (10) having an end wall (2) and a cylindrical inner surface (15), and located in a housing (60), wherein the interior of the drum is accessed by access means (70) and wherein the drum is connected to drive shaft (80) from a drive means (not shown) to effect rotation of the drum.

Features described herein in conjunction with a particular aspect or example of the disclosure are to be understood to be applicable to any other aspect, embodiment or example described herein unless incompatible therewith. As used herein, the words "a" or "an" are not limited to the singular but are understood to include a plurality, unless the context requires otherwise. The term "comprising" encompasses "including" as well as "consisting" and "consisting essentially of" e.g. a feature "comprising" X may consist exclusively of X or may include something additional e.g. X+Y.

The invention claimed is:

1. A drum for rotatably mounting in an apparatus for use in the treatment of substrates with a solid particulate material, said drum having an inner surface and an end wall and access means for introducing said substrates into said drum, wherein said drum comprises:

(a) storage means for storage of said solid particulate material, wherein at least part of said storage means is or comprises at least one cavity located in said end wall of said drum; and (c) a dispensing aperture for dispensing solid particulate material from said storage means into the interior of said drum, wherein said dispensing aperture is comprised in said end wall of said drum, characterised in that said drum comprises a valve that is actuatable between a closed position and an open position, wherein when said valve is in said closed position said solid particulate material is prevented from passing through said dispensing aperture and when said valve is in said open position said solid particulate material is permitted to pass through said dispensing aperture.

2. The drum according to claim 1, wherein said valve is actuatable between said closed position and said open position via a shaft.

3. The drum according to claim 2, wherein said shaft is substantially aligned with the rotational axis of said drum.

4. The drum according to claim 1, wherein said valve is manually actuatable.

5. The drum according to claim 1, wherein said valve is mechanically actuatable.

6. The drum according to claim 1, wherein said valve is electromechanically actuatable, in particular using a lead screw or a solenoid.

7. The drum according to claim 1, wherein said valve comprises a disk portion and a shank portion, and wherein when the valve is in the closed position, there is a gap between said disk portion of said valve and an edge of said dispensing aperture or said end wall of said drum, wherein the size of the gap is such that solid particulate material cannot pass through.

8. The drum according to claim 1, wherein said valve is or forms part of a poppet valve.

9. The drum according to claim 1, wherein said valve projects towards the interior of said drum when said valve is in the open position.

10. The drum according to claim 1, wherein said dispensing aperture is located substantially centrally in said end wall of said drum.

11. The drum of claim 10, wherein said dispensing aperture coincides with the rotational axis of said drum.

12. The drum of claim 1, wherein said drum comprises a plurality of said dispensing apertures.

13. The drum of claim 12, wherein the drum comprises a single valve.

14. The drum of claim 12, wherein the drum comprises a plurality of said valves, in particular the drum comprises a corresponding number of valves as dispensing apertures.

15. The drum of claim 14, wherein said plurality of valves are independently actuatable.

16. The drum of claim 14, wherein said plurality of valves are jointly actuatable, in particular by using an arrangement comprising an articulated rod.

17. The drum according to claim 1 wherein the storage means comprises multiple compartments, for instance, 2, 3, 4, 5 or 6 compartments, particularly wherein said multiple compartments are arranged so as to retain balance of the drum during rotation.

18. The drum according to claim 1, wherein the storage means comprises multiple compartments, wherein each of the compartments is defined by a cavity bound by a first wall and a second wall which each extend outwards from the rotational axis of the drum towards and preferably to the inner wall of the drum.

19. The drum according to claim 17, wherein each compartment is in fluid communication with its adjacent compartment or compartments such that solid particulate material, as well as any liquid medium, is able to pass from one compartment directly into an adjacent compartment during rotation of the drum by a communicating aperture in the wall between adjacent compartments, preferably wherein a communicating aperture exhibits a smallest dimension which is at least 4 times greater than the longest dimension of the solid particulate material, and preferably wherein the largest dimension of the communicating aperture is no greater than 50% of the longest dimension of a wall between adjacent compartments, and preferably wherein said communicating aperture is located in a wall between adjacent compartments at a point that is closer to the mid-point of said wall between adjacent compartments than to either the rotational axis of the drum or the inner wall of the drum.

20. The drum according to claim 17, wherein the multiple compartments are in fluid communication with a single dispensing aperture.

21. The drum according to claim 1, wherein the storage means further comprises one or more perforations which have dimensions smaller than the dimensions of the solid particulate material so as to permit passage of fluids through said perforations into and out of the storage means, particularly from or into the interior of said drum respectively, but to prevent egress of said solid particulate material through said perforations.

22. The drum according to claim 1, comprising a deflector for regulating the flow of solid particulate material through said dispensing aperture.

23. The drum according to claim 1, comprising a deflector configured to bias said solid particulate material within said storage means towards said dispensing aperture.

24. The drum according to claim 23, wherein said storage means comprises multiple compartments and each compartment comprises said deflector.

25. The drum according to claim 1, further comprising a guard positioned between the interior of said drum and said valve, wherein said guard comprises a plurality of apertures, wherein the plurality of apertures permit passage of solid particulate material through said guard but prevent passage of said substrates.

26. The drum according to claim 25, wherein said guard comprises a grill.

27. The drum according to claim 1, wherein said drum comprises a collecting means for facilitating flow of said solid particulate material from the interior of said drum to said storage means.

28. The drum according to claim 27, wherein said collecting means comprises at least one collecting aperture comprised in said end wall of said drum to facilitate flow of said solid particulate material from the interior of said drum to said storage means, wherein preferably said at least one collecting aperture is adjacent the periphery of the end wall of said drum.

29. The drum according to claim 27, wherein said collecting means comprises an elongate protrusion to facilitate flow of said solid particulate material from the interior of said drum to said storage means, wherein said elongate protrusion is located on said inner surface of said drum, wherein said elongate protrusion extends in a direction away from said end wall, wherein said elongate protrusion has an end proximal to the end wall and an end distal to the end wall.

30. The drum according to claim 29, wherein said elongate protrusion comprises a collecting aperture and a collecting flow path to facilitate flow of said particulate material from the interior of said drum to said storage means, wherein said collecting aperture in the elongate protrusion defines the start of said collecting flow path, and wherein said flow of said solid particulate material from the interior of the drum towards the storage means is facilitated by the rotation of said drum in a collecting direction.

31. The drum according to claim 29, wherein said elongate protrusion comprises:

(a) a first collecting flow path to facilitate flow of said solid particulate material from the interior of said drum to a storage means in said drum when said drum rotates in a first collecting direction, and (b) a second collecting flow path to facilitate flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

32. The drums according to claim 31, wherein said first flow path and said second flow path are symmetrically arranged along the length of said elongate protrusion.

33. The drum according to claim 29, wherein said drum comprises a plurality of said elongate protrusions.

34. The drum according to claim 33, wherein said drum comprises two, three, four, five or six of said elongate protrusions.

35. An apparatus for use in the treatment of substrates with a solid particulate material, said apparatus comprising a housing having mounted therein a rotatably mounted drum, wherein said drum is a defined in claim 1.

36. The apparatus according to preceding claim 35, which is configured such that for at least a part of said treatment said drum is tilted such that its axis defines an angle a to the horizontal plane which is greater than 0 and less than about 10° and such that said drum is inclined in a downwards direction from the front of said drum to the end wall of said drum.

37. The apparatus according to claim 35 wherein movement of said solid particulate material between the interior of the drum and the storage means is actuated entirely by rotation of the drum.

38. The apparatus according to claim 35, wherein the inner surface of said drum comprises perforations which have dimensions smaller than the dimensions of the solid particulate material so as to permit passage of fluids into and out of said drum but to prevent egress of said solid particulate material.

39. The apparatus according to claim 38, wherein said housing is a tub which surrounds said drum, preferably wherein said tub and said drum are substantially concentric, preferably wherein the walls of said tub are unperforated but having disposed therein one or more inlets and/or one or more outlets suitable for passage of a liquid medium and/or one or more treatment agents into and out of the tub.

40. The apparatus according to claim 35, wherein said drum has an opening at the opposite end of the drum to the end wall through which said substrates are introduced into said drum.

41. The apparatus according to claim 35, wherein the apparatus does not comprise a further storage means which is not attached to or integral with the drum, and/or wherein the apparatus does not comprise a pump for circulating said solid particulate material between the storage means and the interior of the drum.

42. The apparatus according to claim 35, which comprises said solid particulate material.

43. A method of treating a substrate, the method comprising agitating the substrate in a drum according to claim 1 with solid particulate material.

44. The method according to claim 43 wherein the solid particulate material is re-used in further treatment procedures according to the method.

45. The method according to claim 43 wherein the method is a method for treating multiple batches, wherein a batch comprises at least one substrate, the method comprising agitating a first batch with solid particulate material, wherein said method further comprises the steps of:

(a) collecting said solid particulate material in the storage means;

(b) agitating a second batch comprising at least one substrate with solid particulate material collected from step (a); and (c) optionally repeating steps (a) and (b) for subsequent batch(es) comprising at least one substrate.

46. The method according to claim 43, wherein the method for treating comprises a first period during which said valve is in said open position and a second period during which said valve is in said closed position.

47. The method of claim 46, wherein the duration of said first period is substantially equal to or exceeds the duration of said second period.

48. The method of claim 46, wherein said first period precedes said second period.

49. The method according to claim 43, wherein the method comprises agitating the substrate with solid particulate material and a liquid medium, preferably wherein the liquid medium is aqueous.

50. The method according to claim 43, wherein the method comprises agitating the substrate with said solid particulate material and a treatment formulation.

51. The method according to claim 43, wherein the substrate is or comprises a textile.

52. The method according to claim 51 wherein the treating of said substrate is cleaning, coloration, bleaching, abrading or ageing, or other textile or garment finishing process.

53. The method according to claim 52 for cleaning a substrate wherein the substrate is a soiled substrate.

54. A kit for converting an apparatus which is not suitable for use in the treatment of substrates using a solid particulate material into an apparatus according to claim 35 which is suitable for use in the treatment of substrates using a solid particulate material, wherein the apparatus comprises a housing having mounted therein a rotatably mounted drum having an inner surface and an end wall and which further comprises access means for introducing said substrates into said drum, and wherein said kit comprises:

(a) solid particulate material;

(b) storage means for storage of said solid particulate material, wherein at least part of said storage means is or comprises at least one cavity located in said end wall of said drum;

(c) a dispensing aperture for dispensing solid particulate material from said storage means in to the interior of said drum, wherein said dispensing aperture is comprised in said end wall of said drum; and (d) a valve that is actuatable between a closed position and an open position, wherein when said valve is in said closed position said solid particulate material is prevented from passing through said dispensing aperture and when said valve is in said open position said solid particulate material is permitted to pass through said dispensing aperture.

55. A method of constructing an apparatus according to claim 35 which is suitable for use in the treatment of substrates using a solid particulate material, the method comprising retrofitting a starting apparatus which is not suitable for use in the treatment of substrates using a solid particulate material and which comprises a housing having mounted therein a rotatably mounted drum having an inner surface and an end wall and which further comprises access means for introducing said substrates into said drum, wherein said retrofitting comprises the steps of:

(i) providing solid particulate material, providing one or more storage means for storage of solid particulate material, and providing one or more valves and, optionally, providing at least one elongate protrusion;

(ii) affixing said storage means to one or more interior surface(s) of the drum, wherein at least part of said storage means is or comprises at least one cavity located in said end wall of said drum;

(iii) providing a dispensing aperture for dispensing solid particulate material from said storage means into the interior of said drum in said end wall of said drum;

(iv) affixing said valve to said end wall of said drum; and (v) optionally affixing to an interior surface of the drum said at least one elongate protrusion, wherein said valve is actuatable between a closed position and an open position, wherein when said valve is in said closed position said solid particulate material is prevented from passing through said dispensing aperture and when said valve is in said open position said solid particulate material is permitted to pass through said dispensing aperture.

* * * * *